US010191397B2

(12) United States Patent
Maruo et al.

(10) Patent No.: US 10,191,397 B2
(45) Date of Patent: Jan. 29, 2019

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Keiji Maruo, Osaka (JP); Tomofumi Shimizu, Osaka (JP); Jun Azuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/668,774

(22) Filed: Aug. 4, 2017

(65) Prior Publication Data

US 2018/0046100 A1 Feb. 15, 2018

(30) Foreign Application Priority Data

Aug. 10, 2016 (JP) ..... 2016-157135

(51) Int. Cl.
*G03G 5/05* (2006.01)
*G03G 5/06* (2006.01)
(Continued)

(52) U.S. Cl.
CPC ..... *G03G 5/056* (2013.01); *G03G 5/0609* (2013.01); *G03G 5/0614* (2013.01);
(Continued)

(58) Field of Classification Search
CPC ..... G03G 5/056; G03G 5/0614
See application file for complete search history.

(56) References Cited

U.S. PATENT DOCUMENTS

2004/0101771 A1* 5/2004 Azuma ..... G03G 5/05 430/58.85
2006/0177238 A1* 8/2006 Fukushima ..... G03G 5/04 399/159

FOREIGN PATENT DOCUMENTS

JP S56-135844 A 10/1981
JP 2000258931 A * 9/2000
(Continued)

OTHER PUBLICATIONS

English language machine translation of JP 2014-092594 (May 2014).*

(Continued)

*Primary Examiner* — Christopher D Rodee
(74) *Attorney, Agent, or Firm* — Studebaker & Brackett PC

(57) ABSTRACT

An electrophotographic photosensitive member includes a conductive substrate and a photosensitive layer. The photosensitive layer is a single-layer photosensitive layer. The photosensitive layer contains a charge generating material, a hole transport material, an electron transport material, and a binder resin. The binder resin contains a polyarylate resin. The polyarylate resin is represented by general formula (1). The hole transport material contains a compound represented by general formula (HTM1), (HTM2), (HTM3), (HTM4), (HTM5), (HTM6), or (HTM7). The photosensitive layer has a scratch resistance depth of no greater than 0.50 μm. The photosensitive layer has a Vickers hardness of at least 17.0 HV.

(Continued)

(1)
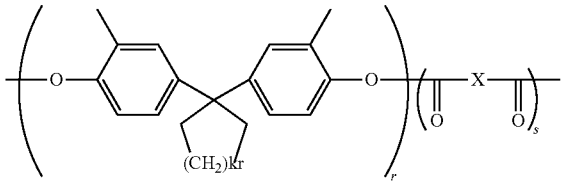
(HTM1)
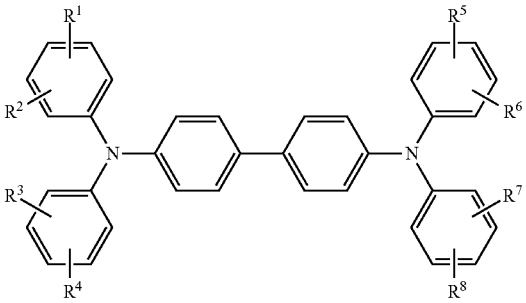
-continued
(HTM2)
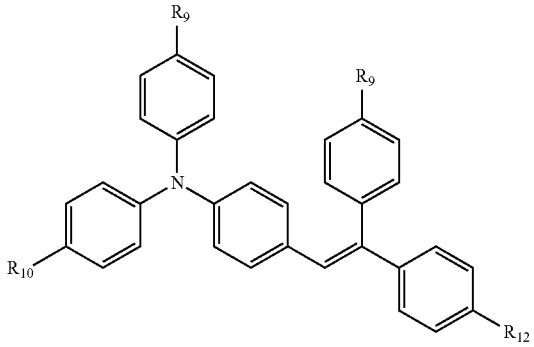
(HTM3)
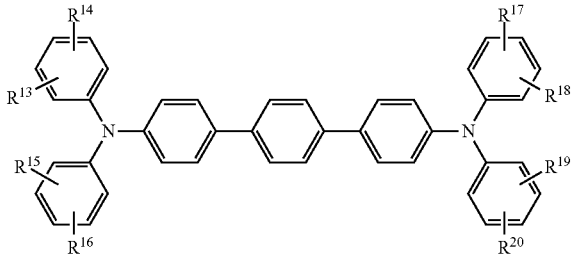
(HTM4)
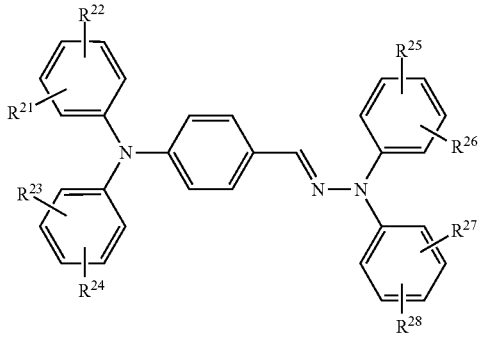
(HTM5)
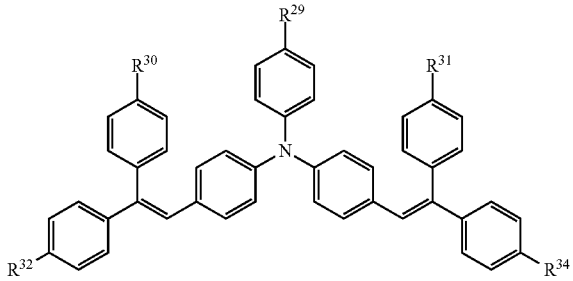

-continued (HTM6)

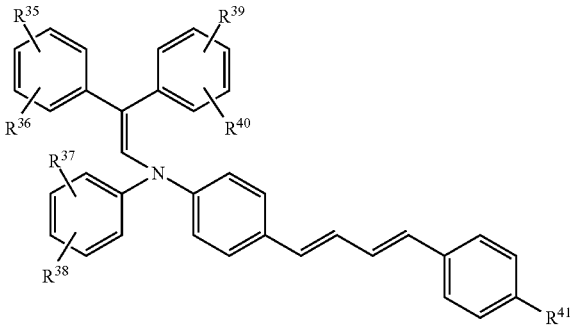

(HTM7)

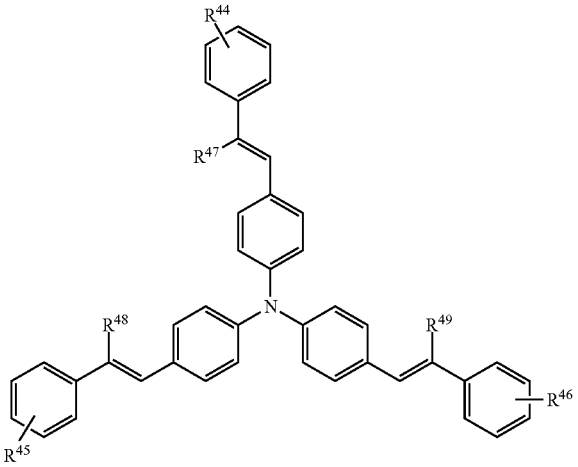

9 Claims, 6 Drawing Sheets

(51) Int. Cl.
*G03G 5/10* (2006.01)
*G03G 15/00* (2006.01)

(52) U.S. Cl.
CPC ..... *G03G 5/0616* (2013.01); *G03G 5/0668* (2013.01); *G03G 5/0672* (2013.01); *G03G 5/0696* (2013.01); *G03G 5/102* (2013.01); *G03G 15/75* (2013.01)

(56) References Cited

FOREIGN PATENT DOCUMENTS

| | | | | | |
|---|---|---|---|---|---|
| JP | 2005-189716 | A | | 7/2005 | |
| JP | 2014092594 | A | * | 5/2014 | |
| WO | WO-2016159244 | A1 | * | 10/2016 | ..... G03G 5/05 |

OTHER PUBLICATIONS

English language machine translation of JP 2000-258931 (Sep. 2000).*
Diamond, Arthur S. (ed). Handbook of Imaging Materials. New York: Marcel-Dekker, Inc. pp. 401-403 (2002).*
Diamond, Arthur S. (ed). Handbook of Imaging Materials. New York: Marcel-Dekker, Inc. pp. 145-164 (2002).*

* cited by examiner

ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2016-157135, filed on Aug. 10, 2016. The contents of this application are incorporated herein by reference in their entirety.

BACKGROUND

The present disclosure relates to an electrophotographic photosensitive member, a process cartridge, and an image forming apparatus.

Electrophotographic photosensitive members are used as image bearing members in electrographic image forming apparatuses (for example, printers and multifunction peripherals). An electrophotographic photosensitive member includes a photosensitive layer. Examples of the electrophotographic photosensitive member include a single-layer electrophotographic photosensitive member and a multi-layer electrophotographic photosensitive member. The single-layer electrophotographic photosensitive member includes a photosensitive layer having a charge generation function and a charge transport function. The multi-layer electrophotographic photosensitive member includes a photosensitive layer including a charge generating layer having a charge generation function and a charge transport layer having a charge transport function.

A polyarylate resin including a repeating unit represented by the following chemical formula (E-1) has been known. An electrophotographic photosensitive member containing the above polyarylate resin has been also known.

(E-1)

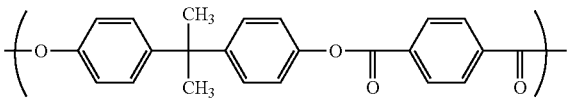

Another polyarylate resin including a repeating unit represented by the following chemical formula (E-2) has been also known. An electrophotographic photosensitive member containing the above polyarylate resin has been also known.

(E-2)

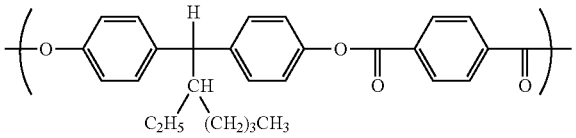

SUMMARY

An electrophotographic photosensitive member according to the present disclosure includes a conductive substrate and a photosensitive layer. The photosensitive layer is a single-layer photosensitive layer. The photosensitive layer contains a charge generating material, a hole transport material, an electron transport material, and a binder resin. The binder resin contains a polyarylate resin. The polyarylate resin is represented by general formula (1). The hole transport material contains a compound represented by general formula (HTM1), (HTM2), (HTM3), (HTM4), (HTM5), (HTM6), or (HTM7). The photosensitive layer has a scratch resistance depth of no greater than 0.50 μm. The photosensitive layer has a Vickers hardness of at least 17.0 HV.

(1)

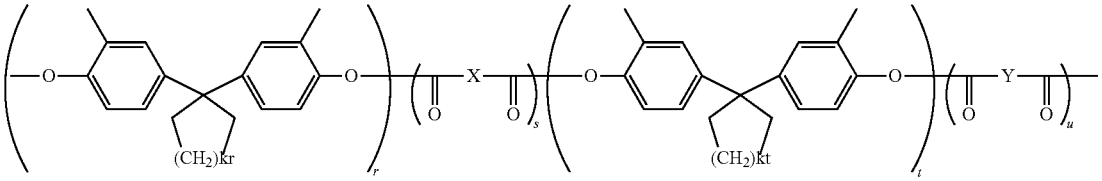

In general formula (1), r, s, t, and u each represent an integer of at least 0, where r+s+t+u=100 and r+t=s+u. Further, s/(s+u) is at least 0.00 and no greater than 0.70. Furthermore, kr and kt each represent 2 or 3. X and Y each represent, independently of one another, a divalent group represented by chemical formula (1-1), (1-2), (1-3), (1-4), (1-5), (1-6), or (1-7).

(1-1)

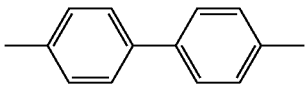

(1-2)

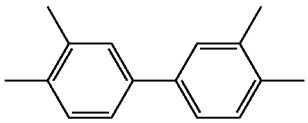

(1-3)

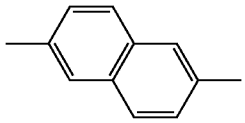

(1-4)

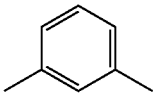

(1-5)

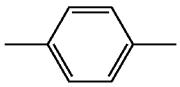

-continued (1-6)

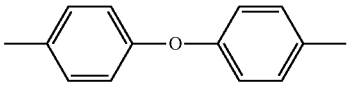

(1-7)

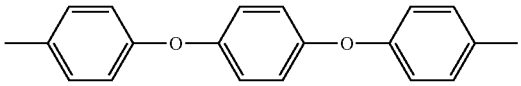

(HTM1)

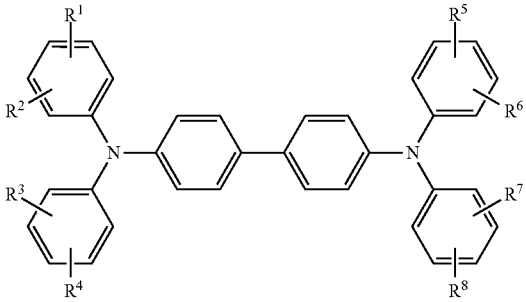

(HTM2)

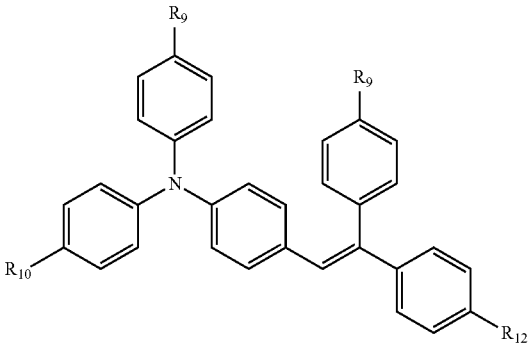

(HTM3)

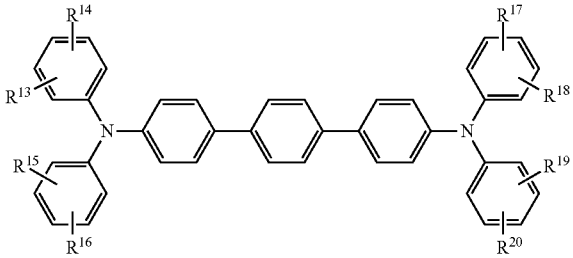

(HTM4)

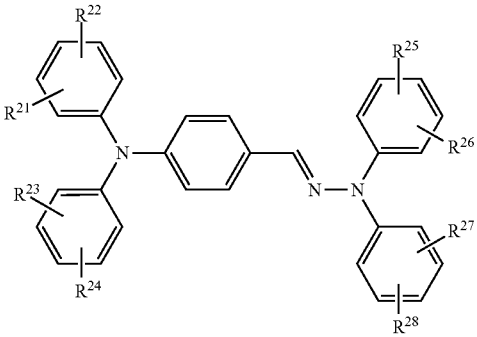

-continued (HTM5)

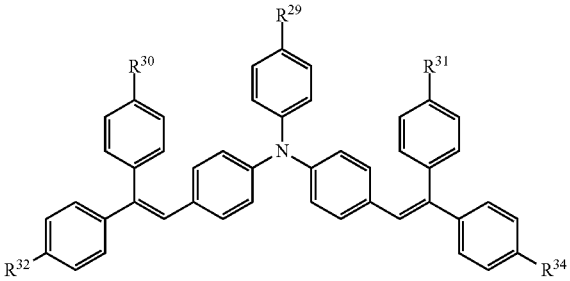

(HTM6)

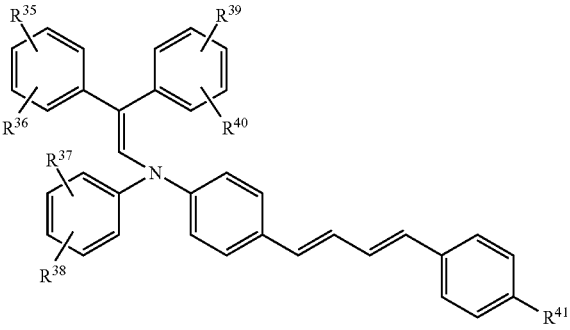

(HTM7)

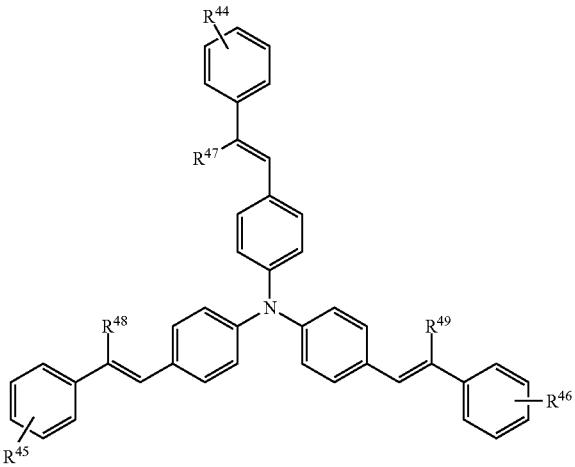

In general formula (HTM1), $R^1$, $R^2$, $R^3$, $R^4$, $R^5$, $R^6$, $R^7$, and $R^8$ each represent, independently of one another, a hydrogen atom or an alkyl group having 1 to 6 carbon atoms. In general formula (HTM2), $R^9$, $R^{10}$, $R^{11}$ and $R^{12}$ each represent, independently of one another, a hydrogen atom or an alkyl group having 1 to 6 carbon atoms. In general formula (HTM3), $R^{13}$, $R^{14}$, $R^{15}$, $R^{16}$, $R^{17}$, $R^{18}$, $R^{19}$, and $R^{20}$ each represent, independently of one another, a hydrogen atom or an alkyl group having 1 to 6. In general formula (HTM4), $R^{21}$, $R^{22}$, $R^{23}$, $R^{24}$, $R^{25}$, $R^{26}$, $R^{27}$, and $R^{28}$ each represent, independently of one another, a hydrogen atom or an alkyl group having 1 to 6. In general formula (HTM5), $R^{29}$, $R^{30}$, $R^{31}$, $R^{32}$, and $R^{34}$ each represent, independently of one another, a hydrogen atom or an alkyl group having 1 to 6 carbon atoms. In general formula (HTM6), $R^{35}$, $R^{36}$, $R^{37}$, $R^{38}$, $R^{39}$, $R^{40}$, and $R^{41}$ each represent, independently of one another, a hydrogen atom or an alkyl group having 1 to 6 carbon atoms. In general formula (HTM7) $R^{44}$, $R^{45}$, $R^{46}$, $R^{47}$, $R^{48}$, and $R^{49}$ each represent, independently of one another, a hydrogen atom, an alkyl group having 1 to 6 carbon atoms, or an optionally substituted phenyl group.

A process cartridge according to the present disclosure includes the above electrophotographic photosensitive member.

An image forming apparatus according to the present disclosure includes an image bearing member, a charger, an exposure section, a developing device, and a transfer section. The image bearing member is the above electrophotographic photosensitive member. The charger charges a surface of the image bearing member. The charger has a positive charge polarity. The exposure device exposes the charged surface of the image bearing member to from an electrostatic latent image on the surface of the image bearing member. The developing device develops the electrostatic latent image into a toner image. The transfer section transfers the toner image from the image bearing member to a recording medium while in contact with the surface of the image bearing member.

DETAILED DESCRIPTION

The following provides detailed explanation of embodiments of the present disclosure. However, the present disclosure is of course not limited by the embodiments and appropriate alterations within the intended scope of the present disclosure can be made when implementing the present disclosure. Although explanation is omitted as appropriate in some instances in order to avoid repetition, such omission does not limit the essence of the present disclosure. In the present description, the term "(meth)acryl" is used as a generic term for both acryl and methacryl. In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

Here, an alkyl group having 1 to 6 carbon atoms, an alkyl group having 1 to 5 carbon atoms, an alkyl group having 1 to 3 carbon atoms, and an alkoxy group having 1 to 6 carbon atoms each refer to the following unless otherwise stated.

The alkyl group having 1 to 6 carbon atoms refers to an unsubstituted straight chain or branched chain alkyl group. Examples of the alkyl group having 1 to 6 carbon atoms include a methyl group, an ethyl group, a propyl group, an isopropyl group, an n-butyl group, an s-butyl group, a t-butyl group, a pentyl group, an isopentyl group, a neopentyl group, and a hexyl group.

The alkyl group having 1 to 5 carbon atoms refers to an unsubstituted straight chain or branched chain alkyl group. Examples of the alkyl group having 1 to 5 carbon atoms include a methyl group, an ethyl group, a propyl group, an isopropyl group, an n-butyl group, an s-butyl group, a t-butyl group, a pentyl group, an isopentyl group, and a neopentyl group.

The alkyl group having 1 to 3 carbon atoms refers to an unsubstituted straight chain or branched chain alkyl group. Examples of the alkyl group having 1 to 3 carbon atoms include a methyl group, an ethyl group, a propyl group, and an isopropyl group.

The alkoxy group having 1 to 6 carbon atoms refers to an unsubstituted straight chain or branched chain alkoxy group. Examples of the alkoxy group having 1 to 6 carbon atoms includes a methoxy group, an ethoxy group, an n-propoxy group, an isopropoxy group, an n-butoxy group, an s-butoxy group, a t-butoxy group, a pentyloxy group, an isopentyloxy group, a neopentyloxy group, and a hexyloxy group.

First Embodiment: Electrophotographic Photosensitive Member

Figure 1A:
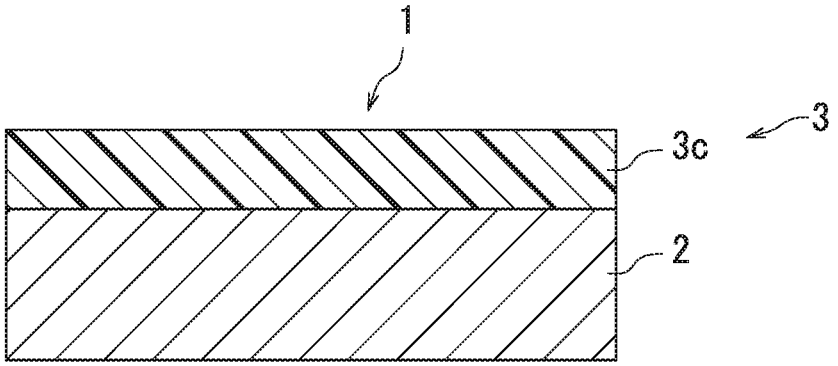
FIGS. 1A, 1B, and 1C each are a cross-sectional view illustrating a configuration of a part of an electrophotographic photosensitive member according to a first embodiment of the present disclosure.
Figure 1B:
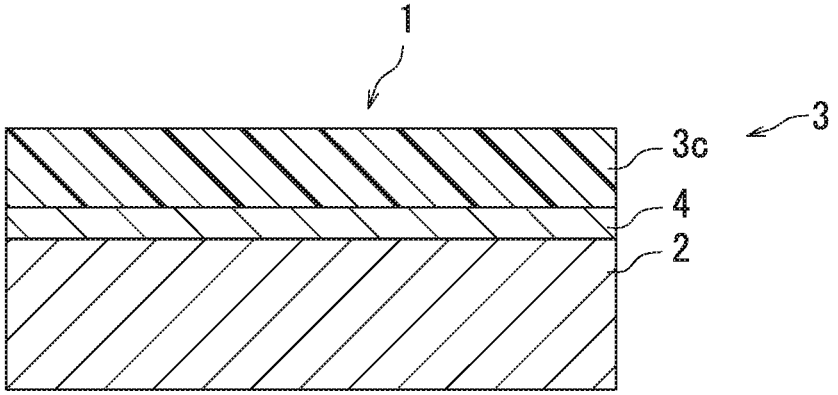
Figure 1C:
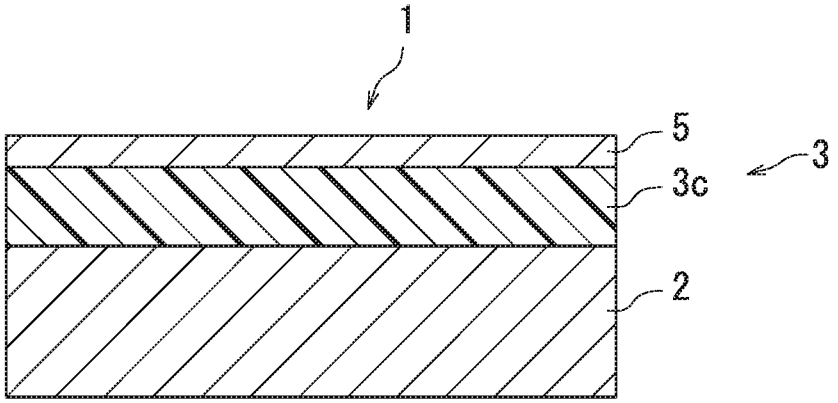

The following describes examples of configuration of an electrophotographic photosensitive member (also referred to below as a photosensitive member) according to a first embodiment of the present disclosure. FIGS. 1A-1C each are a cross-sectional view illustrating a configuration of a part of a photosensitive member 1 according to the first embodiment. As illustrated in FIG. 1A, the photosensitive member 1 includes a conductive substrate 2 and a photosensitive layer 3. The photosensitive layer 3 is a single-layer photosensitive layer 3*c*. The photosensitive layer 3 may be disposed directly on the conductive substrate 2, as illustrated in FIG. 1A. Alternatively, as illustrated in FIG. 1B, the photosensitive member 1 includes for example an intermediate layer 4 (underlying layer) in addition to the conductive substrate 2 and the photosensitive layer 3. The photosensitive layer 3 may be disposed indirectly on the conductive substrate 2, as illustrated in FIG. 1B. The intermediate layer 4 may be disposed between the conductive substrate 2 and the single-layer photosensitive layer 3*c*, as illustrated in FIG. 1B. Further alternatively, as illustrated in FIG. 1C, the photosensitive member 1 may include a protective layer 5 that is a topmost surface layer. In view of the fact that fogging can be favorably inhibited in the presence of the photosensitive layer 3 having a specific scratch resistance depth, preferably, the photosensitive member does not include the protective layer 5. For the same reason as above, it is preferable that the photosensitive layer 3 is provided as a topmost surface layer of the photosensitive member 1.

The following describes elements (the conductive substrate 2, the photosensitive layer 3, and the intermediate layer 4) of the photosensitive member 1 according to the first embodiment. A photosensitive member production method will be also described.

[1. Conductive Substrate]

No particular limitations are placed on the conductive substrate 2 other than being adoptable as a conductive substrate of a photosensitive member. A conductive substrate at least a surface portion of which is made from a conductive material can be used as the conductive substrate 2. Examples of the conductive substrate 2 include a conductive substrate made from a conductive material and a substrate that is conductive by being covered with a conductive material. Examples of the conductive material include aluminum, iron, copper, tin, platinum, silver, vanadium, molybdenum, chromium, cadmium, titanium, nickel, palladium, and indium. One of the conductive materials listed above may be used or two or more of the conductive materials listed above may be used in combination. Examples of the combination of two or more of the conductive materials listed able include alloys specific examples include an aluminum alloy, stainless steel, and brass). Among the conductive materials listed above, aluminum or an aluminum alloy is preferable in terms of excellent mobility of electrical charges from the photosensitive layer 3 to the conductive substrate 2.

Shape of the conductive substrate 2 can be appropriately selected according to a configuration of an image forming apparatus to which the conductive substrate 2 is adopted. Examples of the shape of the conductive substrate 2 include a sheet-like shape and a drum-like shape. Thickness of the conductive substrate 2 is also appropriately selected according to the shape of the conductive substrate 2.

[2. Photosensitive Layer]

The photosensitive layer 3 contains a charge generating material, a hole transport material, an electron transport material, and a binder resin. The photosensitive layer 3 may optionally contain an additive. No particular limitations are placed on the thickness of the photosensitive layer 3 so long as the thickness thereof is sufficient to enable the layer to implement a function thereof. Specifically, the photosensitive layer 3 may have a thickness of at least 5 μm and no greater than 100 μm, and preferably at least 10 μm and no greater than 50 μm.

The Vickers hardness of a photosensitive layer is measured by the following method. The Vickers hardness of a measurement sample (photosensitive layer) is measured by a method in accordance with Japan Industrial Standard (JIS) Z2244. A hardness tester (for example, "Micro Vickers Hardness Tester, Type DMH-1" manufactured by Matsuzawa Co., Ltd. (formerly, Matsuzawa Seiki Co., Ltd.)) is used for Vickers hardness measurement. Vickers hardness measurement can be performed for example under conditions of a temperature of 23° C., a load (test power) of a diamond indenter of 10 gf, a time to reach the test power of 5 seconds, a closing rate of the diamond indenter of 2 mm/sec, and a retention period of the test power of 1 second.

The Vickers hardness of the photosensitive layer 3 is at least 17.0 HV, preferably at least 17.0 HV and no greater than 25.0 HV, more preferably at least 20.5 HV and no greater than 24.0 HV, and further preferably at least 22.4 HV and no greater than 24.0 HV.

The scratch resistance depth (also referred to below as a scratch depth) of the photosensitive layer 3 is a physical property value indicating the hardness of the photosensitive layer 3. The scratch depth of the photosensitive layer 3 is a depth of a scratch formed on the photosensitive layer 3 when the photosensitive layer 3 is scratched using prescribed conditions, which will be described later. The photosensitive layer 3 has a hardness corresponding to a scratch depth of no greater than 0.50 μm. That is, the hardness of the photosensitive layer 3 defined by the scratch depth is no greater than 0.50 μm. The phrase "the hardness of the photosensitive layer 3 defined by the scratch depth is no greater than 0.50 μm" means that the photosensitive layer 3 has a hardness corresponding to a depth of a scratch of no greater than 0.5 μm that is formed using the prescribed conditions described later.

The photosensitive layer 3 has a scratch depth of no greater than 0.50 μm. The photosensitive layer 3 preferably has a scratch depth of at least 0.00 μm and no greater than 0.50 μm, and more preferably at least 0.00 μm and no greater than 0.35 μm.

A scratch depth of a photosensitive layer 3 is measured by the following method. The scratch depth of the photosensitive layer 3 is measured through a first step, a second step, a third step, and a fourth step using a scratching apparatus defined in JIS K5600-5-5. The scratching apparatus includes a fixing table and a scratching stylus. The scratching stylus has a hemi-spherical sapphire tip end having a diameter of 1 mm.

In the first step, a photosensitive member 1 is fixed onto an upper surface of the fixing table such that a longitudinal direction of the photosensitive member 1 is parallel to a longitudinal direction of the fixing table. In the second step, the scratch stylus is brought into perpendicular contact with a surface of the photosensitive layer 3. In the third step, a scratch is formed on the surface of the photosensitive layer 3 using the scratch stylus in a manner that the fixing table and the photosensitive member 1 fixed on the upper surface of the fixing table are moved in the longitudinal direction of the fixing table by 30 mm at a speed of 30 mm/min. while 10 g of a load is applied to the photosensitive layer 3 through the scratch stylus in perpendicular contact with the surface of the photosensitive layer 3. In the fourth step, a scratch depth that is a maximum depth of the scratch is measured. An outline of the scratch depth measuring method is described so far. The scratch depth measuring method will be described later in further detail in Examples.

The following describes the charge generating material, the hole transport material, the electron transport material, the hinder resin, and the additive.

[2-1. Charge Generating Material]

No particular limitations are placed on the charge generating material other than being a charge generating material for a photosensitive member. Examples of the charge generating material include phthalocyanine-based pigments, perylene-based pigments, bisazo pigments, dithioketopyrrolopyrrole pigments, metal-free naphthalocyanine pigments, metal naphthalocyanine pigments, squaraine pigments, trisazo pigments, indigo pigments, azulenium pigments, cyanine pigments, pyrylium salts, anthanthrone-based pigments, triphenylmethane-based pigments, threne-based pigments, toluidine-based pigments, pyrazoline-based pigments, quinacridon-based pigments, and powders of inorganic photoconductive materials such as selenium, selenium-tellurium, selenium-arsenic, cadmium sulfide, and amorphous silicon. Examples of phthalocyanine-based pigments include phthalocyanine pigments and pigments of phthalocyanine derivatives. Examples of phthalocyanine pigments include metal-free phthalocyanine pigments (a specific example is an X-form metal-free phthalocyanine pigment (x-$H_2$Pc)). Examples of pigments of phthalocyanine derivatives include metal phthalocyanine pigments (specific examples include a titanyl phthalocyanine pigment and a V-form hydroxygallium phthalocyanine pigment). No particular limitations are placed on crystal structure of the phthalocyanine-based pigments and a phthalocyanine-based pigment having any crystal structure is usable. Examples of the crystal structure of the phthalocyanine-based pigment include α-form, β-form, and Y-form. One of the charge generating materials listed above may be used or two or more of the charge generating materials listed above may be used in combination. A phthalocyanine-based pigment is preferable among the charge generating materials listed above, and an X-form metal-free phthalocyanine pigment is more preferable.

One or a combination of two or more of charge generating materials having an absorption wavelength in a desired region may be used. For example, a photosensitive member having sensitivity in a wavelength range of at least 700 nm is preferably used in a digital optical image forming apparatus. Examples of the digital optical image forming apparatus include a laser beam printer and a facsimile machine each with a light source such as a semiconductor laser. For use in a photosensitive member of the above image forming apparatus, for example, a phthalocyanine-based pigment is preferable and an X-form metal-free phthalocyanine pigment (x-$H_2$Pc) or a Y-form titanyl phthalocyanine pigment (Y-TiOPc) is more preferable. Note that the Y-form titanyl phthalocyanine pigment may have one peak at a Bragg angle $2\theta \pm 0.2° = 27.2°$ in a Cu—Kα characteristic X-ray diffraction spectrum.

An anthanthrone-based pigment or a perylene-based pigment is suitably used as a charge generating material of a photosensitive member adopted in an image forming apparatus with a short-wavelength laser light source. The wavelength of the short-wavelength laser is for example at least 350 nm and no greater than 550 nm.

The charge generating material is for example a phthalocyanine-based pigment represented by any of chemical formulas (CGM-1)-(CGM-4) (also referred to below as charge generating materials (CGM-1)-(CGM-4), respectively).

(CGM-1)

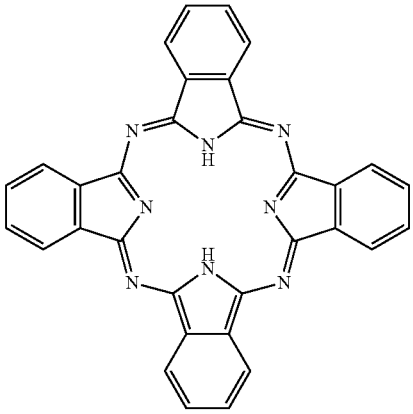

(CGM-2)

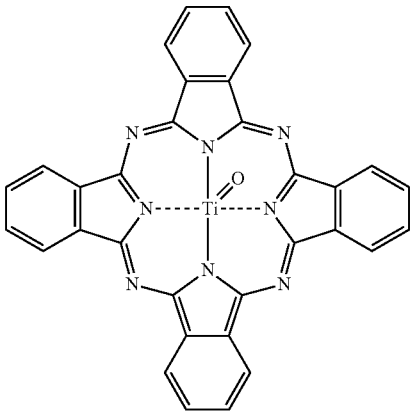

-continued (CGM-3)

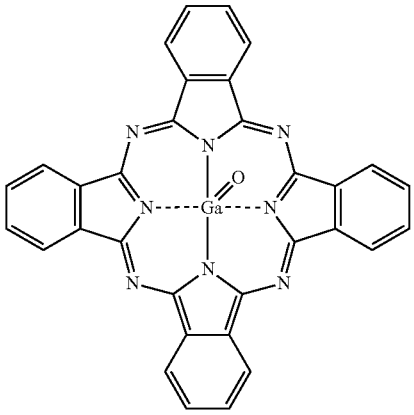

(CGM-4)

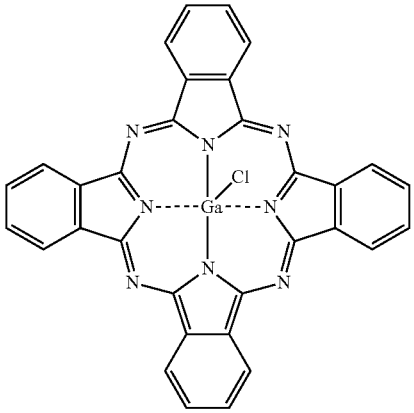

The content of the charge generating material is preferably at least 0.1 parts by mass and no greater than 50 parts by mass relative to 100 parts by mass of the binder resin, more preferably at least 0.5 parts by mass and no greater than 30 parts by mass, and particular preferably at least 0.5 parts by mass and no greater than 4.5 parts by mass.

[2-2. Hole Transport Material]

The hole transport material contains a compound represented by general formula (HTM1), (HTM2), (HTM3), (HTM4), (HTM5), (HTM6), or (HTM7) (also referred to below as hole transport materials (HTM1)-(HTM7), respectively).

(HTM1)

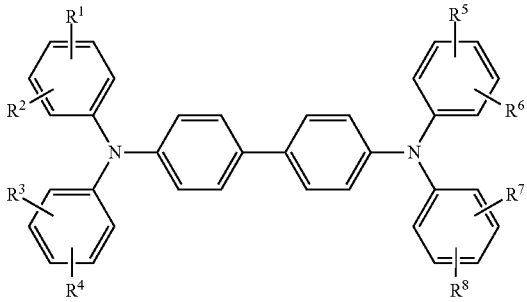

In general formula (HTM1), $R^1$, $R^2$, $R^3$, $R^4$, $R^5$, $R^6$, $R^7$, and $R^8$ each represent, independently of one another, a hydrogen atom or an alkyl group having 1 to 6 carbon atoms, preferably a hydrogen atom or an alkyl group having 1 to 3 carbon atoms, and further preferably a hydrogen atom or a methyl group. An example of the hole transport material (HTM1) is a hole transport material represented by chemical formula (HTM1) (also referred to below as a hole transport material (HTM1-1)).

(HTM1-1)

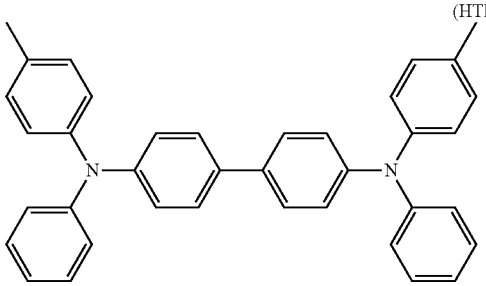

(HTM2)

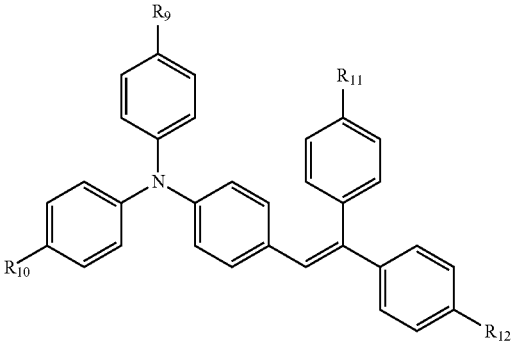

In general formula (HTM2), $R^9$, $R^{10}$, $R^{11}$, and $R^{12}$ each represent, independently of one another, a hydrogen atom or an alkyl group having 1 to 6 carbon atoms, preferably a hydrogen atom or an alkyl group having 1 to 3 carbon atoms, and further preferably a hydrogen atom or a methyl group. An example of the hole transport material (HTM2) is a hole transport material represented by chemical formula (HTM2-1) (also referred to below as a hole transport material (HTM2-1)).

(HTM2-1)

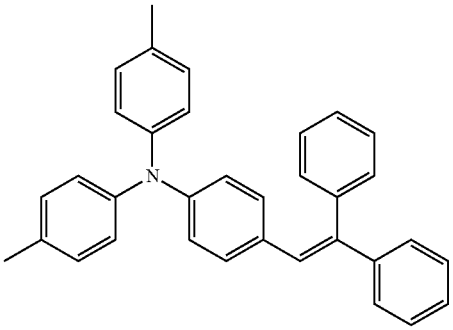

-continued (HTM3)

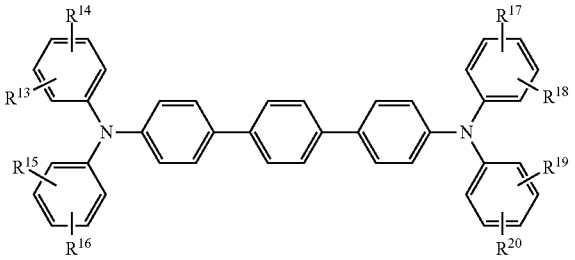

In general formula (HTM3), $R^{13}$, $R^{14}$, $R^{15}$, $R^{16}$, $R^{17}$, $R^{18}$, $R^{19}$, and $R^{20}$ each represent, independently of one another, a hydrogen atom or an alkyl group having 1 to 6 carbon atoms, preferably a hydrogen atom or an alkyl group having 1 to 3 carbon atoms, and further preferably a hydrogen atom or a methyl group. An example of the hole transport material (HTM3) is a hole transport material represented by chemical formula (HTM3-1) (also referred to below as a hole transport material (HTM3-1))

(HTM3-1)

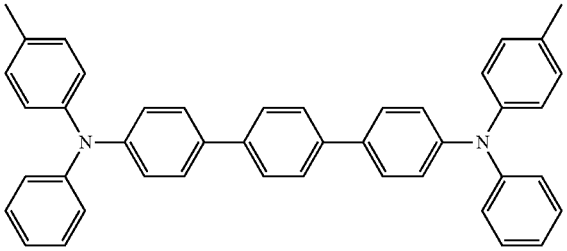

(HTM4)

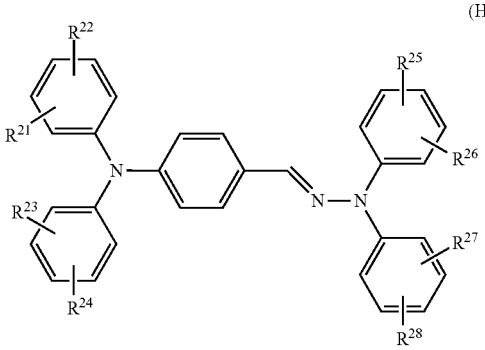

In general formula (HTM4), $R^{21}$, $R^{22}$, $R^{23}$, $R^{24}$, $R^{25}$, $R^{26}$, $R^{27}$, and $R^{28}$ each represent, independently of one another, a hydrogen atom or an alkyl group having 1 to 6 carbon atoms, preferably a hydrogen atom or an alkyl group having 1 to 3 carbon atoms, and further preferably a hydrogen atom or a methyl group. An example of the hole transport material (HTM4) is a hole transport material represented by chemical formula (HTM4-1) (also referred to below as a hole transport material (HTM4-1)).

(HTM4-1)

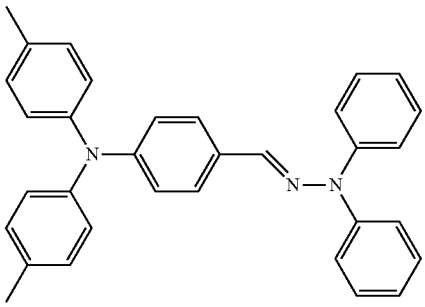

(HTM5)

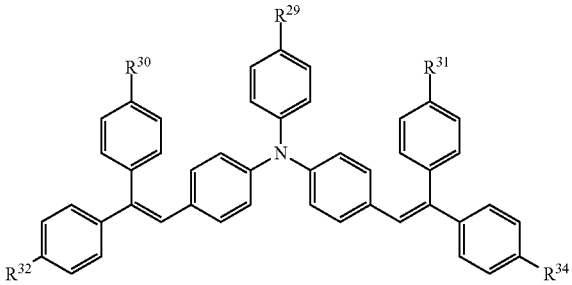

In general formula (HTM5), $R^{29}$, $R^{30}$, $R^{31}$, $R^{32}$, and $R^{34}$ each represent, independently of one another, a hydrogen atom or an alkyl group having 1 to 6 carbon atoms, preferably an alkyl group having 1 to 3 carbon atoms, and further preferably a methyl group. An example of the hole transport material (HTM5) is a hole transport material represented by chemical formula (HTM5-1) (also referred to below as a hole transport material (HTM5-1)).

(HTM5-1)

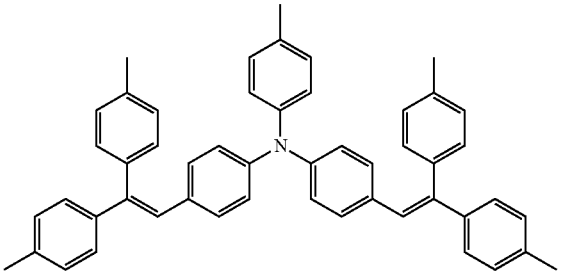

(HTM6)

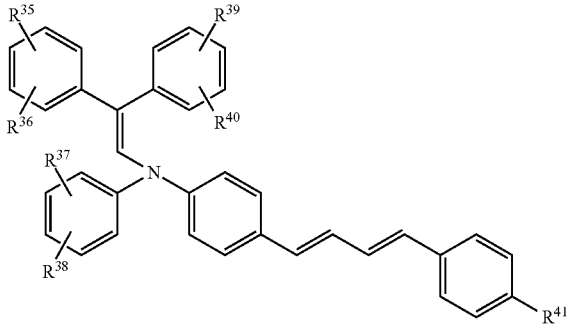

In general formula (HTM6), $R^{35}$, $R^{36}$, $R^{37}$, $R^{38}$, $R^{39}$, $R^{40}$, and $R^{41}$ each represent, independently of one another, a hydrogen atom or an alkyl group having 1 to 6 carbon atoms and preferably a hydrogen atom. An example of the hole transport material (HTM6) is a hole transport material represented by chemical formula (HTM6-1) (also referred to below as a hole transport material (HTM6-1)).

(HTM6-1)

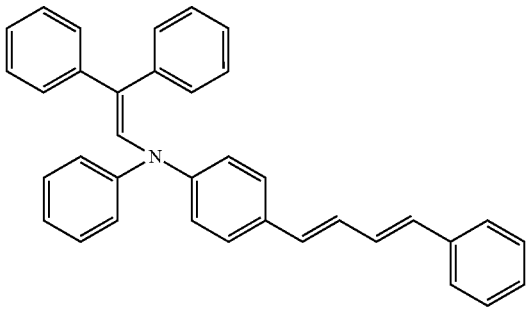

(HTM7)

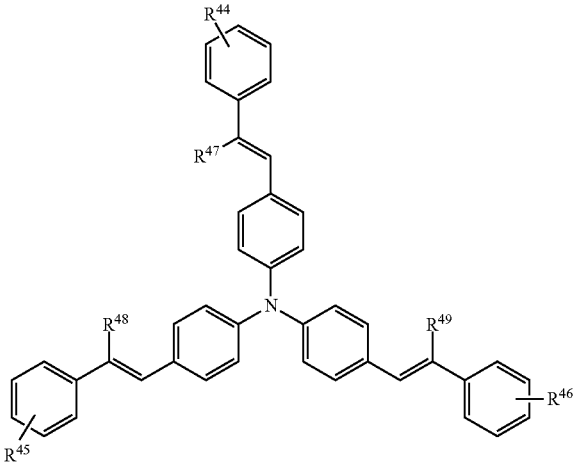

In general formula (HTM7), $R^{44}$, $R^{45}$, $R^{46}$, $R^{47}$, $R^{48}$, and $R^{49}$ each represent, independently of one another, a hydrogen atom, an alkyl group having 1 to 6 carbon atoms, or a optionally substituted phenyl group, preferably a hydrogen atom, an alkyl group having 1 to 3 carbon atoms, or a phenyl group, and further preferably a hydrogen atom, a methyl group, or a phenyl group. Where $R^{44}$ to $R^{49}$ each represent a phenyl groups, the phenyl group may be optionally substituted. Examples of such a substituent include a halogen atom, an alkyl group having 1 to 6 carbon atoms, alkoxy group having 1 to 6 carbon atoms, and an aryl group having 6 to 14 carbon atoms. Example of the hole transport material (HTM7) include hole transport materials represented by chemical formulas (HTM7-1) and (HTM7-2) (also referred to below as hole transport materials (HTM7-1) and (HTM7-2), respectively).

(HTM7-1)

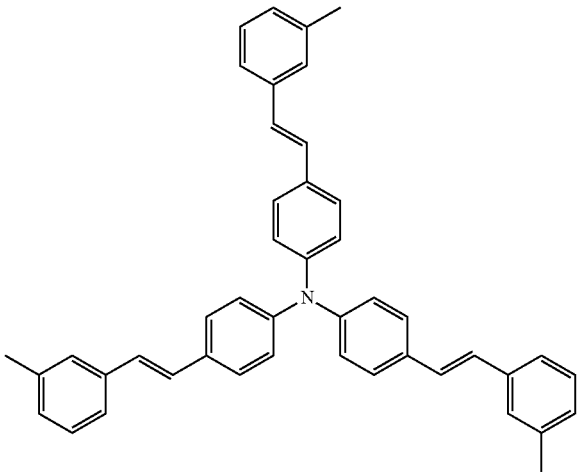

(HTM7-2)

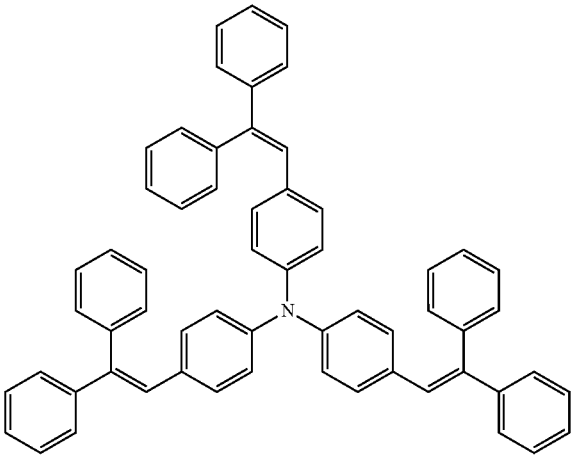

The hole transport material may optionally contain a compound as a hole transport material other than any of the compounds represented by respective general formulas (HTM1)-(HTM7) contained in the hole transport material. Examples of the other hole transport material that can be used include a nitrogen-containing cyclic compound and a condensed polycyclic compound. Examples of the nitrogen-containing cyclic compound and the condensed polycyclic compound include: diamine derivatives (for example, a benzidine derivative, an N,N,N',N'-tetraphenylphenylenediamine derivative, an N,N,N',N'-tetraphenylnaphtylenediamine derivative, and an N,N,N',N'-tetraphenylphenanthrylenediamine derivative); oxadiazole-based compounds (for example, 2,5-di(4-methylaminophenyl)-1,3,4-oxadiazole); styryl-based compounds (for example, 9-(4-diethylaminostyryl)anthracene); carbazole-based compounds (for example, polyvinyl carbazole); organic polysilane compounds; pyrazoline-based compounds (for example, 1-phenyl-3-(p-dimethylaminophenyl)pyrazoline); hydrazone-based compounds; indole-based compounds; oxazole-based compounds; isoxazole-based compounds; thiazole-based compounds; thiadiazole-based compounds; imidazole-based compounds; pyrazole-based compounds; and triazole-based compounds.

The content of the hole transport material is preferably at least 10 parts by mass and no greater than 200 parts by mass relative to 100 parts by mass of the binder resin, and more preferably at least 10 parts by mass and no greater than 100 parts by mass.

[2-3. Electron Transport Material]

Examples of the electron transport material include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroarithracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds include a diphenoquinone-based compound, an azoquinone-based compound, an anthraquinone-based compound, a naphthoquinone-based compound, a nitoanthraquinone-based compound, and a dinitroanthraquinone-based compound. One of the electron transport materials listed above may be used or two or more of the electron transport materials listed above may be used in combination.

A compound represented by general formula (ETM1) is preferable among the electron transport materials listed above.

(ETM1)

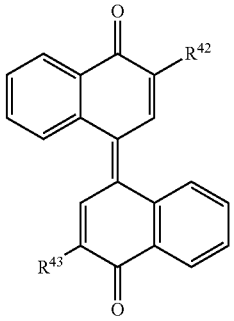

In general formula (ETM1), $R^1$ and $R^2$ each represent, independently of one another, an alkyl group having 1 to 6 carbon atoms or an alkoxy group having 1 to 6 carbon atoms, preferably an alkyl group having 1 to 5 carbon atoms, and further preferably a 2-methyl-2-butyl group. An example of the electron transport material (ETM1) is an electron transport material represented by chemical formula (ETM1-1) (also referred to below as an electron transport material (ETM1-1)).

(ETM1-1)

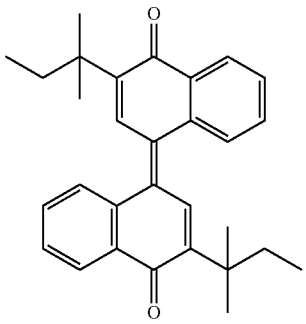

[2-4. Binder Resin]

The binder resin contains a polyarylate resin. The polyarylate resin is represented by general formula (1). The above polyarylate resin may be referred below to as a polyarylate resin (1).

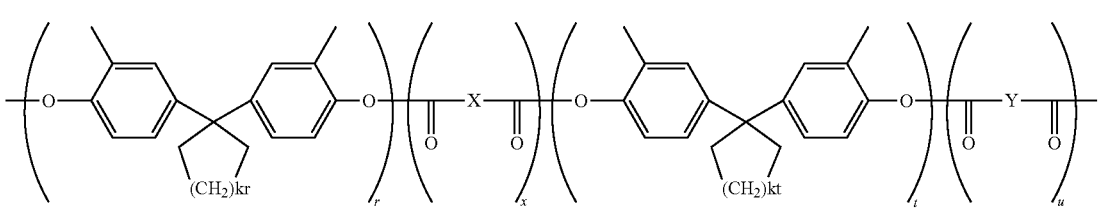

(1)

In general formula (1), r, s, t, and u each represent an integer of at least 0, wherein r+s+t+u=100 and r+t=s+u. Further, s/(s+u) is at least 0.00 and no greater than 0.70. Note that kr and kt each represent 2 or 3. X and Y each represent, independently of one another, a divalent group represented by chemical formula (1-1), (1-2), (1-3), (1-4), (1-5), (1-6), or (1-7). Preferably, r and s each represent, independently of one another, an integer of at least 0 and t and u each represent, independently of one another, an integer of at least 1.

(1-1)

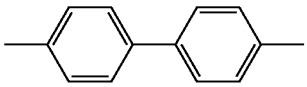

(1-2)

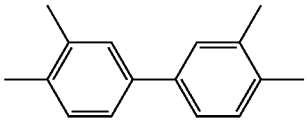

(1-3)

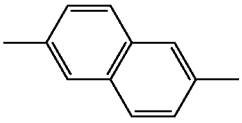

(1-4)

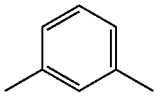

(1-5)

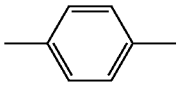

(1-6)

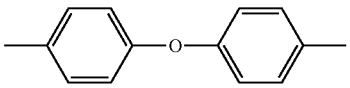

(1-7)

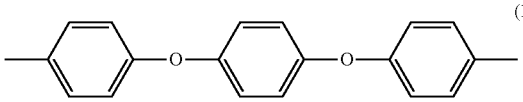

Preferably, X and Y each represent a divalent group represented by, chemical formula (1-1), (1-3), (1-4), (1-5), (1-6), or (1-7) and kr and kt each represent 3 in general formula (1). Preferably, X is different from Y. In addition, the photosensitive member 1 further preferably has a Vickers hardness of at least 22.4 HV in order to further improve anti-fogging property.

In general formula (1), s/(s+u) is preferably at least 0.30.

The polyarylate resin (1) includes a repeating unit represented by general formula (1-5) (also referred to below as a repeating unit (1-5)), a repeating unit represented by general formula (1-6) (also referred to below as a repeating unit (1-6)), a repeating unit represented by general formula (1-7) (also referred to below as a repeating unit (1-7)), and a repeating unit represented by general formula (1-8) (also referred to below as a repeating unit (1-8)).

(1-5)

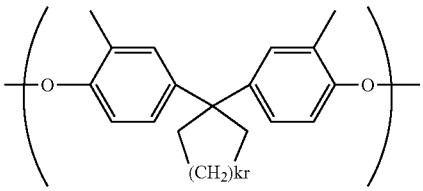

(1-6)

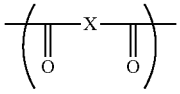

(1-7)

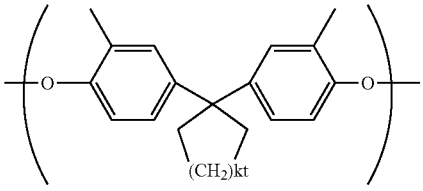

(1-8)

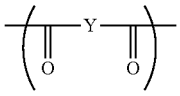

In the repeating units (1-5)-(1-8), kr, X, kt and Y represent the same as kr, X, kt, and Y in general formula (1), respectively.

The polyarylate resin (1) may optionally include a repeating unit other than repeating units (1-5)-(1-8). A ratio (mole fraction) of a total amount of the repeating units (1-5)-(1-8) relative to a total amount of all repeating units in the polyarylate resin (1) is preferably at least 0.80, more preferably 0.90, and further preferably 1.00.

No particular limitations are placed on arrangement of the repeating units (1-5)-(1-8) in the polyarylate resin (1) as long as repeating units derived from aromatic diols are each located adjacent to a repeating unit derived from an aromatic dicarboxylic acid. For example, the repeating unit (1-5) is located adjacent and bonded to the repeating unit (1-6) or (1-8). Similarly, the repeating unit (1-7) is located adjacent and bonded to the repeating unit (1-6) or (1-8). The polyarylate resin (1) may optionally include a repeating unit other than the repeating units (1-5)-(1-8).

In general formula (1), s/(s+u) represents a ratio (mole fraction) of the amount of the repeating unit (1-6) relative to a total amount of the repeating units (1-6) and (1-8) in the polyarylate resin (1).

Examples of the polyarylate resin (1) include polyarylate resins represented by chemical formulas (R-1)-(R-6), (R-11), and (R-12) (also referred to below as polyarylate resins (R-1)-(R-6), (R-11), and (R-12), respectively).

(R-1)

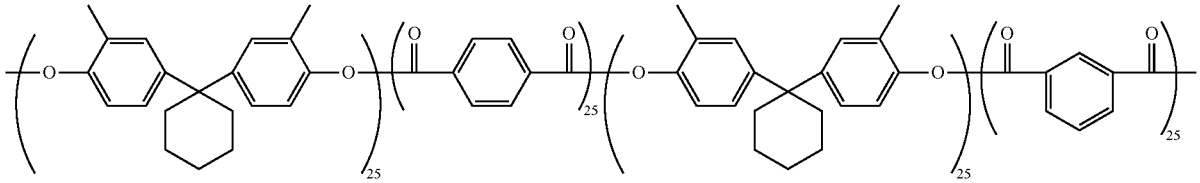

(R-2)

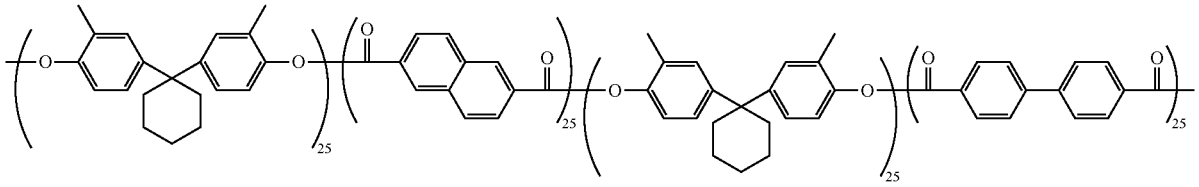

(R-3)

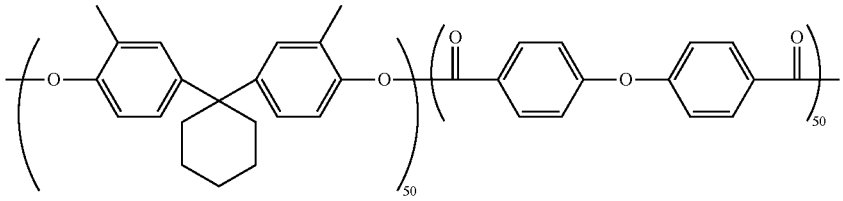

(R-4)

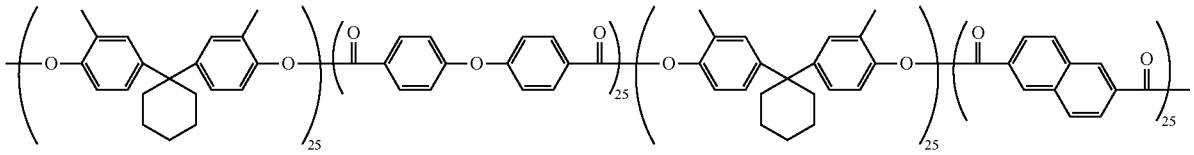

(R-5)

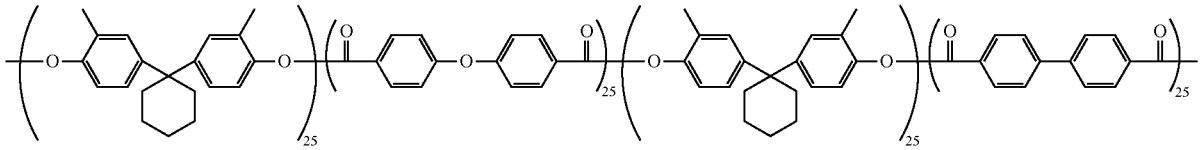

(R-6)

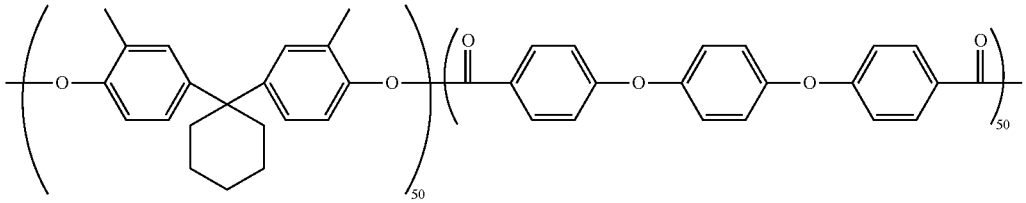

(R-11)

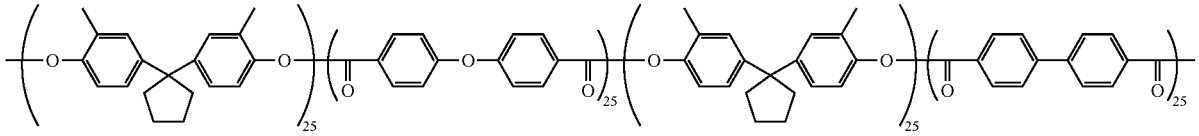

-continued (R-12)

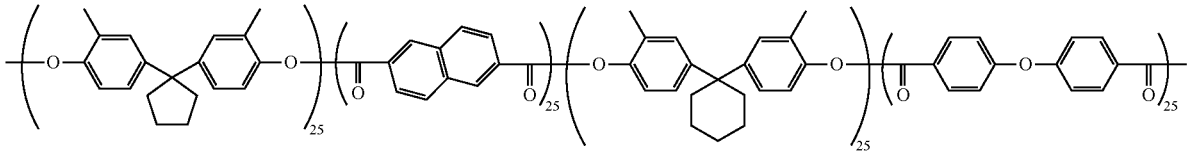

In a configuration in which the binder resin is the polyarylate resins (R-1)-(R-6), (R-11), or (R-12), the photosensitive layer 3 preferably has a scratch depth of no greater than 0.35 μm in terms of improving anti-fogging property of the photosensitive member 1.

It is preferable that the hole transport material contains a compound represented by general formula (HTM1), (HTM2), or (HTM6) and the polyarylate resin (1) is represented by chemical formula (R-1), (R-2), or (R-6) in terms of further improving anti-fogging property of the photosensitive member.

The polyarylate resin (1) preferably has a viscosity average molecular weight of at least 33,000 and no greater than 37,000. In a configuration in which the polyarylate resin (1) has a viscosity average molecular weight of at least 33,000, abrasion resistance of the photosensitive member 1 can be increased with a result that the photosensitive layer 3 hardly abrades. By contrast, in a configuration in which the polyarylate resin (1) has a viscosity average molecular weight of no greater than 37,000, the polyarylate resin (1) hardly dissolves in a solvent in photosensitive layer formation with a result that the photosensitive layer formation can be facilitated.

The polyarylate resin (1) may be used alone as the hinder resin. Alternatively, a resin other than the polyarylate resin (1) (another resin) may be contained in the binder resin within a range not impairing the advantages of the present disclosure. Examples of the other resin include thermoplastic resins (specific examples include a polyarylate resin other than the polyarylate resin (1), a polycarbonate resin, a styrene-based resin, a styrene-butadiene copolymer, a styrene-acrylonitrile copolymer, a styrene-maleic acid copolymer, a styrene-acrylic acid copolymer, an acrylic copolymer, a polyethylene resin, an ethylene-vinyl acetate copolymer, a chlorinated polyethylene resin, a polyvinyl chloride resin, a polypropylene resin, ionomer, a vinyl chloride-vinyl acetate copolymer, a polyester resin, an alkyd resin, a polyamide resin, a polyurethane resin, a polysulfone resin, a diallyl phthalate resin, a ketone resin, a polyvinyl butyral resin, a polyether resin, and a polyester resin), thermosetting resins (specific examples include a silicone resin, an epoxy resin, a phenolic resin, a urea resin, a melamine resin, and other crosslinkable thermosetting resins), and photocurable resins (specific examples include an epoxy-acryl acid-based resin and a ulethane-acrylic acid-based copolymer). One of the resins listed above may be used or two or more of the resins listed above may be used in combination.

No particular limitations are placed on a production method of the polyarylate resin (1) as long as the polyarylate resin (1) can be produced. An example of the production method is condensation polymerization of aromatic dials and aromatic dicarboxylic acids for forming the repeating units of the polyarylate resin (1). No particular limitations are placed on synthesis of the polyarylate resin (1) and any known synthesis (specific examples include solution polymerization, melt polymerization, and interface polymerization) can be employed.

The aromatic dicarboxylic acids each have two carboxyl groups and are represented by respective general formulas (1-9) and (1-10). X in general formula (1-9) and Y in general formula (1-10) represent the same as X and Y in general formula (1), respectively.

(1-9)

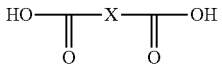

(1-10)

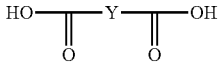

Examples of the aromatic dicarboxylic acids include aromatic dicarboxylic acids each having two carboxyl groups bonded on an aromatic ring (specific examples include 4,4'-dicarboxydiphenyl ether and 4,4'-dicarboxybiphenyl). Note that an aromatic dicarboxylic acid can be used as a derivative such as acid dichloride, dimethyl ester, or diethyl ester in synthesis of the polyarylate resin (1). The aromatic dicarboxylic acids may include an aromatic dicarboxylic acid (for example, terephthalic acid, isophthalic acid, or 2,6-naphthalene dicarboxylic acid) other than the aromatic dicarboxylic acids represented by respective general formulas (1-9) and (1-10).

The aromatic diols each have two phenolic hydroxyl groups and examples of the aromatic diols include aromatic diols represented by respective general formula (1-11) and (1-12). Note that kr in general formula (1-11) and kt in general formula (1-12) represent the same as kr and kt in general formula (1), respectively.

(1-11)

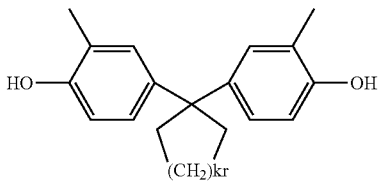

(1-12)

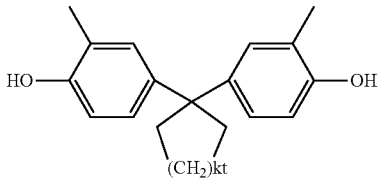

A content ratio of the binder resin is preferably at least 40% by mass relative to a total mass of all elements of constitution contained in the photosensitive layer 3 (for example, the charge transport material, the hole transport material, the electron transport material, and the binder resin), and more preferably at least 80% by mass.

[2-5. Additive]

Either or both of the photosensitive layer 3 and the intermediate layer 4 may contain one or more additives within a range not adversely affecting the electrophotographic characteristics. Examples of the additives include antidegradants (specific examples include an antioxidant, a radical scavenger, a quencher, and a ultraviolet absorbing agent), softeners, surface modifiers, extenders, thickeners, dispersion stabilizers, waxes, electron acceptor compounds, donors, surfactants, and leveling agents. Antioxidants will be described among the additives listed above.

Examples of the antioxidants include hindered phenol compounds, hindered amine compounds, thioether compounds, and phosphite compounds. A hindered phenol compound or a hindered amine compound is preferable among the antioxidants listed above.

The additive amount of an antioxidant in the photosensitive layer is preferably at least 0.1 parts by mass and no greater than 10 parts by mass relative to 100 parts by mass of the binder resin. In a configuration in which the additive amount of the antioxidant is within the range as above, degradation of electrical characteristics caused due to oxidation of the photosensitive member 1 tends to be inhibited.

[3. Intermediate Layer]

The photosensitive member 1 according to the first embodiment may include the intermediate layer 4 (for example, an undercoat layer). The intermediate layer 4 contains for example inorganic particles and a resin (intermediate layer resin). In the presence of the intermediate layer 4, electric current generated in exposure of the photosensitive member 1 can smoothly flow while an insulation state to an extent that occurrence of leakage current can be inhibited is maintained, thereby suppressing an increase in electric resistance.

Examples of the inorganic particles include particles of metals (specific examples include aluminum, iron, and copper), particles of metal oxides (specific examples include titanium oxide, alumina, zirconium oxide, tin oxide, and zinc oxide), and particles of non-metal oxides (a specific example is silica). One type of the inorganic particles listed above may be used or two or more types of the inorganic particles listed above may be used in combination.

[4. Photosensitive Member Production Method]

The following describes a photosensitive member production method. The photosensitive member production method includes for example a photosensitive layer formation step.

In the photosensitive layer formation step, an application liquid for forming a photosensitive layer 3 (also referred to below as an application liquid for photosensitive layer formation) is prepared. The application liquid for photosensitive layer formation is applied to a conductive substrate to form an applied film. The applied film is then dried by an appropriate method to remove at least a part of a solvent contained in the applied film, thereby forming a photosensitive layer 3. The application liquid for photosensitive layer formation contains for example a charge generating material, a hole transport material, an electron transport material, a binder resin, and a solvent. The application liquid for photosensitive layer formation as above is prepared by dissolving or dispersing the charge generating material, the hole transport material, the electron transport material, and the binder resin in the solvent. One or more additives may be added to the application liquid for photosensitive layer formation as needed.

The photosensitive layer formation step will be described in detail below. No particular limitations are placed on the solvent contained in the application liquid for photosensitive layer formation as long as the respective components contained in the application liquid for photosensitive layer formation can be dissolved or dispersed in the solvent. Specific examples of the solvent include alcohols (more specific examples include methanol, ethanol, isopropanol, and butanol), aliphatic hydrocarbons (more specific examples include n-hexane, octane, and cyclohexane), aromatic hydrocarbons (more specific examples include benzene, toluene, and xylene), halogenated hydrocarbons (more specific examples include dichloromethane, dichloroethane, carbon tetrachloride, and chlorobenzene), ethers (more specific examples include dimethyl ether, diethyl ether, tetrahydrofuran, ethylene glycol dimethyl ether, and diethylene glycol dimethyl ether), ketones (more specific examples include acetone, methyl ethyl ketone, and cyclohexanone), esters (more specific examples include ethyl acetate and methyl acetate), dimethyl formaldehyde, dimethyl formamide, and dimethyl sulfoxide. One of the solvents listed above may be used or two or more of the solvents listed above may be used in combination. A non-halogenated solvent is preferable among the solvents listed above.

The application liquid for photosensitive layer formation is prepared by mixing the respective components and dispersing the components in the solvent. The components can be mixed or dispersed using a bead mill, a roll mill, a ball mill, an attritor, a paint shaker, or a ultrasonic disperser.

The application liquid for photosensitive layer formation may contain for example a surfactant or a leveling agent in order to improve dispersibility of the respective components or surface smoothness of the respective layers to be formed.

No particular limitations are placed on a method for applying the application liquid for photosensitive layer formation as long as uniform application of the application liquid for photosensitive layer formation can be achieved. Examples of the application method include dip coating, spray coating, spin coating, and bar coating.

No particular limitations are placed on a method for removing at least a part of the solvent contained in the application liquid for photosensitive layer formation as long as art least a part of the solvent in the application liquid for photosensitive layer formation can be removed (specifically, by evaporation or the like). Examples of the removal method include heat application, pressure application, and combinational application of heat and pressure. A more specific example is a heat treatment (hot-air drying) using a high-temperature dryer or a reduced pressure dryer. Conditions of the heat treatment include for example a temperature of at least 40° C. and no greater than 150° and a time period of at least three minutes and no greater than 120 minutes.

Note that the photosensitive member production method may additionally include an intermediate layer formation step as needed. An appropriate known method can be selected for the intermediate layer formation step.

The photosensitive member 1 in the present disclosure described above, which is excellent in anti-fogging property, can be favorably used in various types of image forming apparatuses.

Second Embodiment: Image Forming Apparatus

Figure 2:
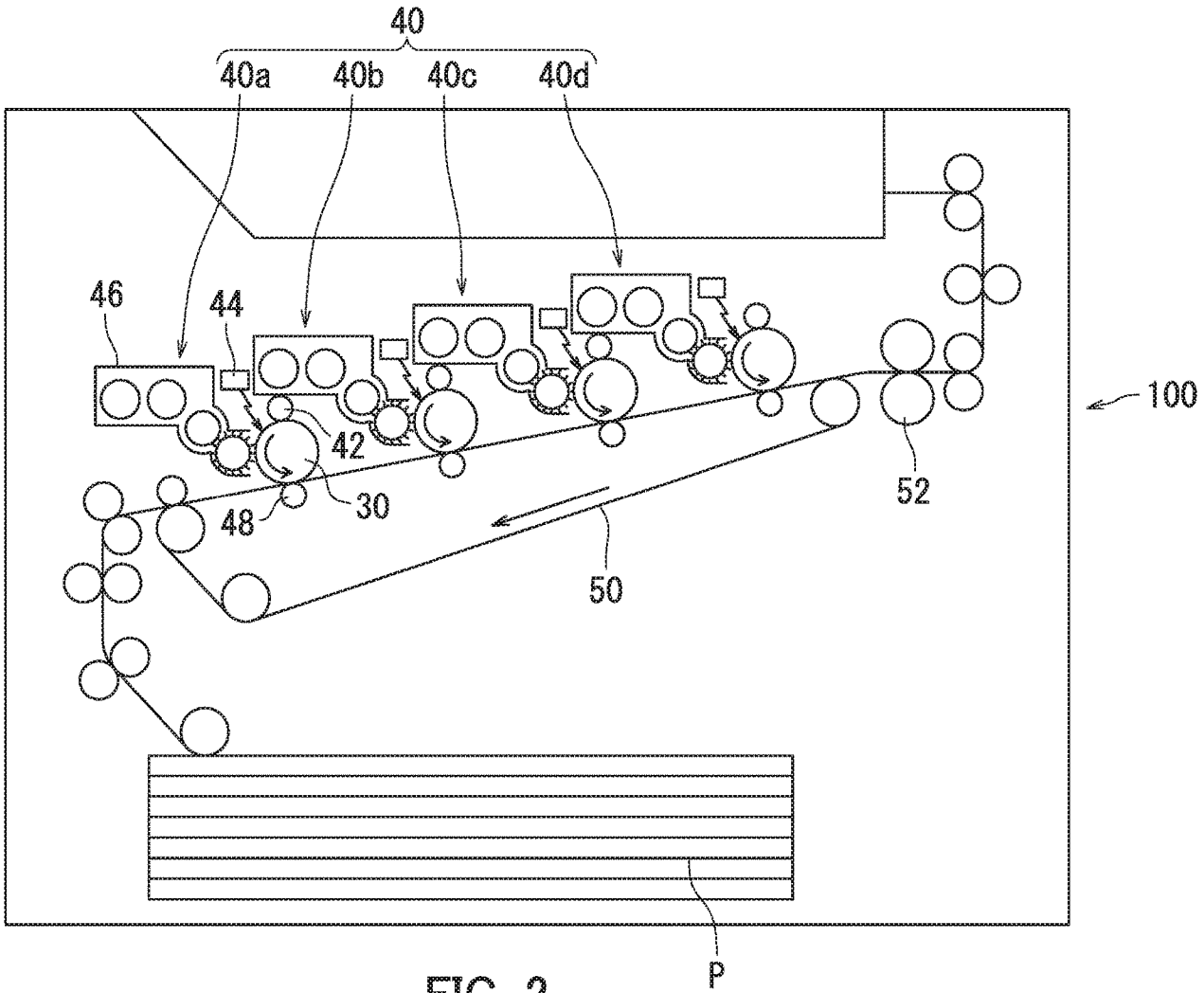
FIG. 2 illustrates an example of an image forming apparatus according to a second embodiment of the present disclosure.

A configuration of the image forming apparatus according to a second embodiment will be described below with reference to FIG. 2. FIG. 2 illustrates an example of the image forming apparatus according to the second embodiment.

An image forming apparatus 100 according to the second embodiment includes an image bearing member 30, a charger 42, an exposure section 44, a developing device 46, and a transfer section 48. The image bearing member 30 corresponds to the photosensitive member 1 according to the first embodiment. The charger 42 charges a surface of the image bearing member 30. The charger 42 has a positive polarity. The exposure section 44 exposes the charged surface of the image bearing member 30 to form an electrostatic latent image on the surface of the image bearing member 30. The developing device 46 develops the electrostatic latent image into a toner image. The transfer section 48 transfers the toner image from the image bearing member 30 to a recording medium P in a state in which the recording medium P is in contact with the surface of the image bearing member 30. The outline of the image forming apparatus 100 according to the second embodiment is described so far.

The respective elements of the image forming apparatus 100 will be described next in detail with reference to FIG. 2. No particular limitations are place on the image forming apparatus 100 other than being an electrographic image forming apparatus. The image forming apparatus 100 may be for example a monochrome image forming apparatus or a color image forming apparatus. In a configuration in which the image forming apparatus 100 is a color image forming apparatus, the image forming apparatus 100 is for example a tandem image forming apparatus. A tandem image forming apparatus will be described below as an example of the image forming apparatus 100.

The image forming apparatus 100 further includes image forming units 40*a*, 40*b*, 40*c*, and 40*d*, a transfer belt 50, and a fixing section 52. Each of the image forming units 40*a*, 40*b*, 40*c*, and 40*d* will be referred below to as an image forming unit 40 where it is not necessary to distinguish among the image forming units 40*a*-40*d*. In a configuration in which the image forming apparatus 100 is a monochrome image forming apparatus, the image forming apparatus 100 includes only the image forming unit 40*a* and the image forming units 40*b*-40*d* are omitted.

The image forming units 40 are each constituted by the image bearing member 30, the charger 42, the exposure section 44, the developing device 46, and the transfer section 48. The image bearing member 30 is disposed at a central part of the image forming unit 40. The image bearing member 30 is rotatable in an arrowed direction (anticlockwise) in FIG. 2. The charger 42, the exposure section 44, the developing device 46, and the transfer section 48 are disposed around the image bearing member 30 in stated order starling from the charger 42 from upstream to downstream in a rotational direction of the image bearing member 30. The image forming unit 40 may further include either or both of a cleaner (not illustrated) and a static eliminator (not illustrated).

Toner images in respective plural colors (for example, four colors of black, cyan, magenta, and yellow) are sequentially superposed by the image forming units 40*a*-40*d* one on the other on the recording medium P placed on the transfer belt 50.

The charger 42 charges the surface of the image bearing member 30 while in contact with the surface of the image bearing member 30. The charger 42 is a contact charger. Examples of the contact charger include a charging roller and a charging brush. Alternatively, the charger 42 may be a non-contact charger. Examples of the non-contact charger include a corotron charger and a scorotron charger.

The charger 42 tends to cause components remaining on the surface of the image bearing member 30 (also referred to below as "residual components") to adhere to the surface of the image bearing member 30. Examples of the residual components include toner components and more specifically toner or an external additive that separates from the toner. Another example of the residual components is non-toner components and more specifically micro components of the recording medium P (for example, paper dust). The residual components usually tend to adhere to the surface of the image bearing member 30. In view of the above, the image forming apparatus 100 in the second embodiment includes the photosensitive member 1 according to the first embodiment. The photosensitive member 1 in the first embodiment is excellent in anti-fogging property. For the reason as above, occurrence of an image defect can be reduced in the image forming apparatus 100 in the second embodiment even including the contact charger 42.

The exposure section 44 exposes the charged surface of the image bearing member 30. Exposure as above forms an electrostatic latent image on the surface of the image bearing member 30. The electrostatic latent image is formed based on image data input to the image forming apparatus 100.

The developing device 46 supplies toner to the surface of the image bearing member 30 to develop the electrostatic latent image into a toner image. The developing device 46 is capable of developing an electrostatic latent image into a toner image while in contact with the surface of the image bearing member 30.

The developing device 46 is capable of cleaning the surface of the image bearing member 30. That is, a cleaning method using no blade cleaner can be adopted to the image forming apparatus 100. The developing device 46 is capable of removing the residual components. In the image forming apparatus 100 to which a cleaning method using no blade cleaner is adopted, residual components on the surface of the image bearing member 30 are not scraped by a cleaner (for example, a cleaning blade). In the above configuration, residual components usually tend to remain on the surface of the image bearing member 30 in the image forming apparatus 100 to which the cleaning method using no blade cleaner is adopted, whereas the photosensitive member 1 in the first embodiment is excellent in anti-fogging property. The photosensitive member 1 in the first embodiment is excellent in anti-fogging property. In the configuration including the photosensitive member 1, the residual components, particularly, micro components for example, paper dust) of the recording medium P hardly remain on the surface of the photosensitive member 1 of the image forming apparatus 100 even which employs the cleaning method using no blade cleaner. As a result, occurrence of an image defect (for example, fogging) can be reduced in the image forming apparatus 100.

The following conditions (a) and (b) are preferably satisfied in order that the developing device 46 efficiently cleans the surface of the image bearing member 30.

Condition (a): Development is performed by contact development and peripheral speeds (rotational speed) are differentiated between the image bearing member 30 and the developing device 46.

Condition (b): The surface potential of the image bearing member 30 and the potential of a developing bias satisfy the following inequalities (b-1) and (b-2).

0 (V)<Potential (V) of developing bias<Surface potential (V) of unexposed region of image bearing member 30 (b-1)

Potential (V) of developing bias>Surface potential (V) of exposed region of image bearing member 30>0 (V) (b-2)

In a configuration in which development is performed by contact development and the peripheral speeds are differentiated between the image bearing member 30 and the developing device 46 as described in Condition (a), the surface of the image bearing member 30 is in contact with the developing device 46 to cause friction with the developing device 46, thereby removing components adhering to the surface of the image bearing member 30. The peripheral speed of the developing device 46 is preferably higher than that of the image bearing member 30.

Condition (b) assumes reversal development as a development scheme. It is preferable that the charging polarity of the toner, the respective surface potentials of an unexposed region and an exposed region of the image bearing member 30, and the potential of the developing bias are all positive in order to improve electrical characteristics of the image bearing member 30 that has the positive charging polarity. The surface potentials of the unexposed and exposed regions of the image bearing member 30 are measured after the transfer section 48 transfers the toner image from the image bearing member 30 to a recording medium P through a rotation of the image bearing member 30 for image formation and before the charger 42 charges the surface of the image bearing member 30 for the next rotation of the image bearing member 30.

When inequality (b-1) in Condition (b) is satisfied, static repulsion acting between toner remaining on the image bearing member 30 (also referred to below as residual toner) and the unexposed region of the image bearing member 30 is larger than static repulsion acting between the residual toner and the developing device 46. For the reason as above, the residual toner on the unexposed region of the image bearing member 30 moves from the surface of the image bearing member 30 to the developing device 46 to be collected.

When inequality (b-2) in Condition (b) is satisfied, static repulsion acting between the residual toner and the exposed region of the image bearing member 30 is smaller than the static repulsion acting between the residual toner and the developing device 46. For the reason as above, the residual toner on the exposed region of the image bearing member 30 is held on the surface of the image bearing member 30. The toner held on the exposed region of the image bearing member 30 is directly used for image formation.

The transfer belt 50 conveys the recording medium P between the image bearing member 30 and the transfer section 48. The transfer belt 50 is an endless belt. The transfer belt 50 is rotatable in an arrowed direction (clockwise) in FIG. 2.

The transfer section 48 transfers the toner image developed by the developing device 46 from the surface of the image bearing member 30 to the recording medium P. An example of the transfer section 48 is a transfer roller. The surface of the image bearing member 30 is in contact with the recording medium P during the toner image being transferred from the image bearing member 30 to the recording medium P. In the above configuration, micro components usually tend to adhere to the surface of the image bearing member 30. In view of the above, the image forming apparatus 100 in the second embodiment includes the photosensitive member 1 in the first embodiment as the image bearing member 30. The photosensitive member 1 in the first embodiment is excellent in nti-fogging property. For the reason as above, occurrence of an image defect can be reduced in the image forming apparatus 100 in the second embodiment even including the contact charger 42.

The fixing section 52 applies either or both of heat and pressure to the unfixed toner image transferred to the recording medium P by the transfer section 48. The fixing section 52 includes either or both of a heating roller and a pressure roller. Application of both or either of heat and pressure to the toner image fixes the toner image to the recording medium P. As a result, an image is formed on the recording medium P.

The image forming apparatus 100 according to the second embodiment is described so far. Occurrence of an image defect can be reduced in the image forming apparatus 100 in the second embodiment that includes the photosensitive member 1 in the first embodiment as the image bearing member 30.

Third Embodiment: Process Cartridge

A process cartridge according to a third embodiment includes the photosensitive member 1 in the first embodiment. The process cartridge according to the third embodiment will be described with further reference to FIG. 2.

The process cartridge includes a unified portion that includes an image bearing member 30 as the photosensitive member 1. The unified portion includes at least one selected from the group consisting of a charger 42, an exposure section 44, a developing device 46, and a transfer section 48 in addition to the image bearing member 30. The process cartridge corresponds to for example each of the image forming units 40*a*-40*d*. The process cartridge may further include either or both of a cleaner (not illustrated) and a static eliminator (not illustrated). The process cartridge is designed to be attachable to and detachable from the image forming apparatus 100. In the above configuration, the process cartridge can be easily handled. As a result, easy and speedy replacement of the process cartridge including the image bearing member 30 can be achieved in a situation in which sensitivity characteristics or the like of the image bearing member 30 are degraded.

The process cartridge according to the third embodiment is described so far. Occurrence of an image defect caused due to generation of transfer memory can be reduced by providing the process cartridge according to the third embodiment that includes the photosensitive member 1 in the first embodiment as the image bearing member 30.

EXAMPLES

The following provides more specific explanation of the present disclosure through examples. Note that the present disclosure is not in any way limited by the following examples.

Materials of Photosensitive Member (Electron Transport Material)

The hole transport material (HTM1-1) described in the first embodiment was prepared.

(Hole Transport Material)

The hole transport materials (HTM1-1)-(HTM7-1) described in the first embodiment were prepared. Electron transport materials (HTM8-1) and (HTM9-1) were additionally prepared. The hole transport materials (HTM8-1) and (HTM9-1) are represented by chemical formulas (HTM8-1) and (HTM9-1), respectively.

(HTM8-1)

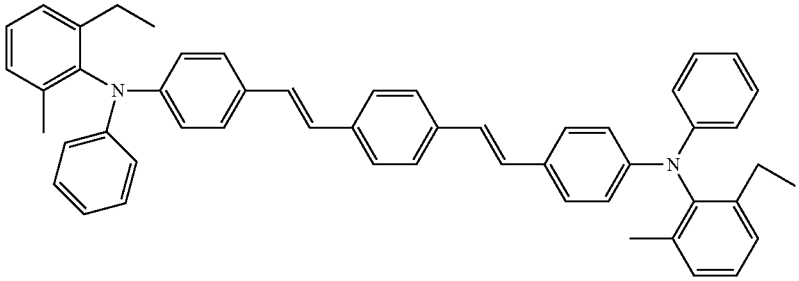

(HTM9-1)

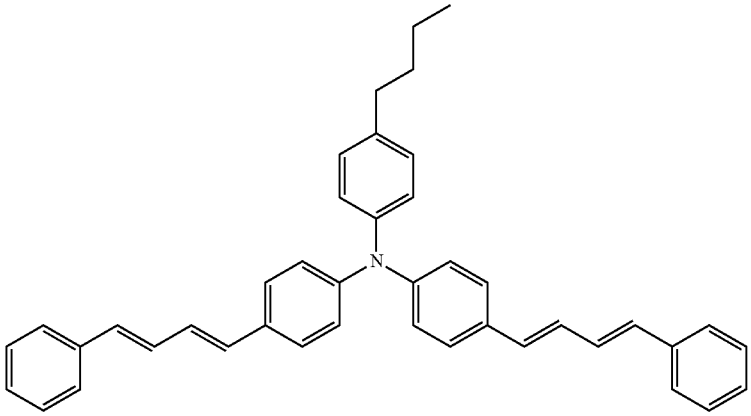

(Charge Generating Material)

The charge generating material (CGM-1) described in the first embodiment was prepared. The charge generating material (CGM-1) was X-form metal-free phthalocyanine.

(Binder Resin)

The polyarylate resins (R-1)-(R-6), (R-11), and (R-12) described in the first embodiment were prepared. Binder resins (R-7)-(R-10) were also prepared. The binder resins (R-7)-(R-10) include repeating units represented by the following chemical formulas (R-7)-(R-10), respectively.

(R-7)

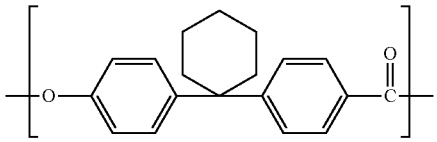

(R-8)

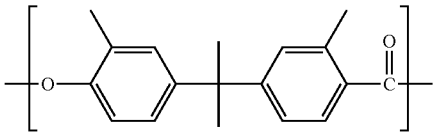

(R-9)

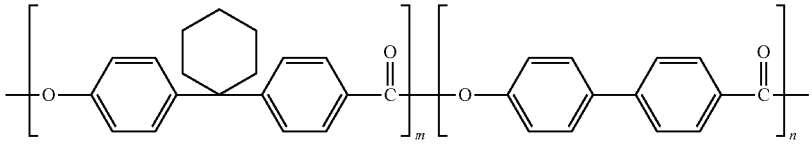

(R-10)

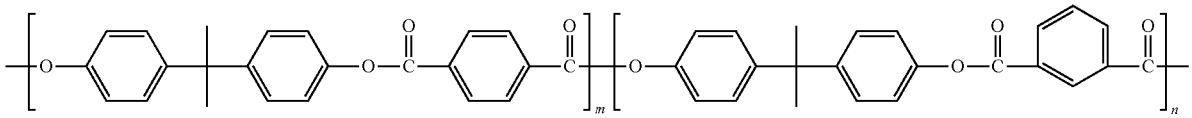

Production of Photosensitive Member

[Production of Photosensitive Member (A-1)]

Production of a photosensitive member (A-1) of Example 1 will be described below.

To a container, 2 parts by mass of the charge generating material (CGM-1), 50 parts by mass of the hole transport material (HTM1-1), 30 parts by mass of the electron transport material (ETM1-1), 100 parts by mass of the polyarylate resin (R-1) as a binder resin, and 800 parts by mass of tetrahydrofuran that is a solvent were added. The container contents were mixed for 50 hours using a ball mill to disperse the materials in the solvent. Through the above dispersion, an application liquid for photosensitive layer formation was yielded. The application liquid for photosensitive layer formation was applied to a drum-shaped aluminum support member (diameter: 30 mm, total length: 238.5 mm) as a conductive substrate by dip coating. The applied application liquid for photosensitive layer formation was hot-air dried for 60 minutes at a temperature of 120° C. Through the above, a single-layer photosensitive layer (film thickness: 30 μm) was formed on the conductive substrate. As a result, the photosensitive member (A-1) was produced.

[Production of Photosensitive Members (A-2)-(A-25) and (B-1)-(B-8)]

Photosensitive members (A-2)-(A-25) and (B-1)-(B-8) were produced according to the same method as for the photosensitive member (A-1) in all aspects other than that polyarylate resins listed in Tables 1 and 2 were used in place of the polyarylate resin (R-1) and electron transport materials listed in Tables 1 and 2 were used in place of the electron transport material (HTM1-1).

[Measuring Method]

(Vickers Hardness Measurement)

Vickers hardness measurement was performed on the photosensitive layer (single-layer photosensitive layer) of each of the produced photosensitive members (A-1)-(A-25) and (B-1)-(B-8). A method in accordance with Japan Industrial Standard (JIS) Z2244 was employed for measuring the Vickers hardness of the photosensitive layer. A hardness tester ("Micro Vickers Hardness Tester, Type DMH-1" manufactured by Matsuzawa Co., Ltd. (formerly, Matsuzawa Seiki Co., Ltd.)) was used to measure the Vickers hardness. The Vickers hardness measurement was performed under conditions of a temperature of 23° C., a load (test power) of a diamond indenter of 10 gf, a time to reach the test power of 5 seconds, a closing rate of the diamond indenter of 2 mm/sec, and a retention period of the test power of 1 second. Tables 1 and 2 list measured Vickers harnesses.

(Scratch Depth Measurement)

Scratch depth measurement was performed on the photosensitive layer (single-layer photosensitive layer) of each of the produced photosensitive members (A-1)-(A-25) and (B-1)-(B-8). A scratching apparatus 200 defined in Japan Industrial Standard K5600-5-5 (JIS K5600: Paints and vanishes—Test method, Part 5: Mechanical Property of Film, Section 5: Scratch Hardness (Stylus method)) was the used for the scratch depth measurement.

Figure 3:
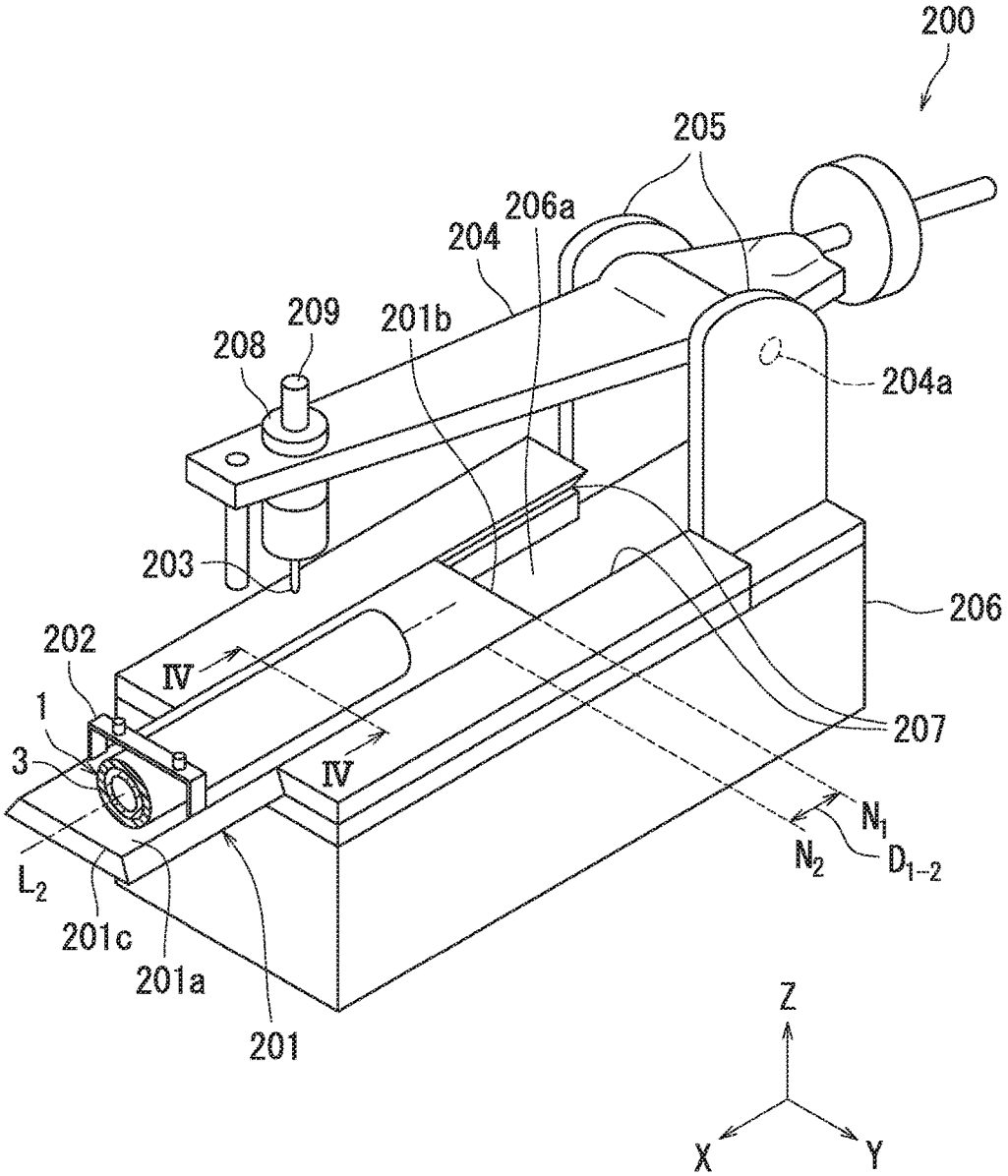
FIG. 3 is a diagram illustrating an example of a configuration of a scratching apparatus.

The following describes the scratching apparatus 200 with reference to FIG. 3. FIG. 3 illustrates an example of a configuration of the scratching apparatus 200. The scratching apparatus 200 includes a fixing table 201, a fixing jig 202, a scratching stylus 203, a support arm 204, two shaft supports 205, a base 206, two rails 207, a weight pan 208, and a constant speed motor (not illustrated).

Figure 5:
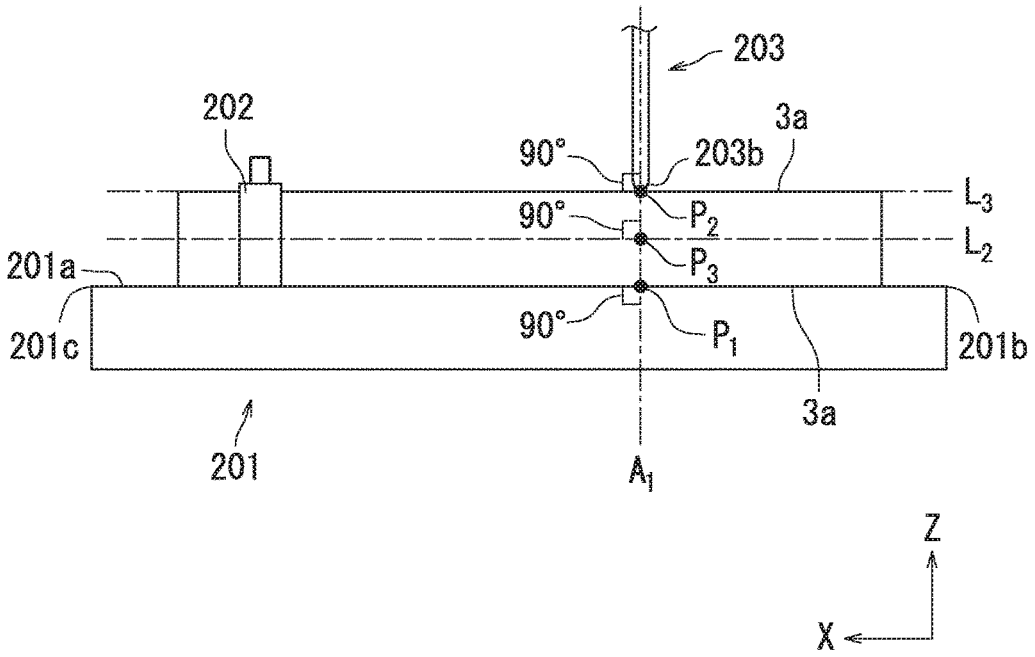
FIG. 5 is a side view of a fixing table, a scratching stylus, and an electrophotographic photosensitive member illustrated in FIG. 3.
Figure 6:
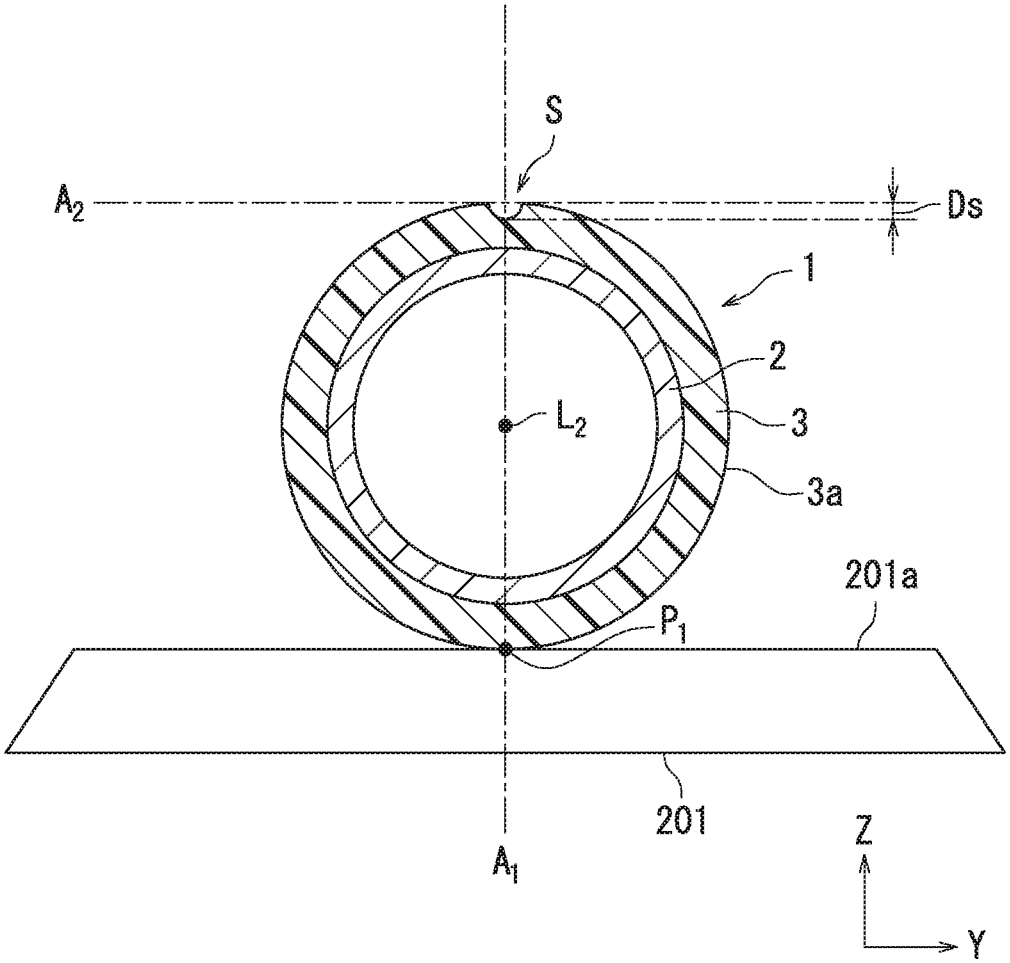
FIG. 6 is a diagram illustrating a scratch S formed on a surface of a photosensitive layer.

In FIG. 3, X and Y directions each are a horizontal direction and a Z direction is a vertical direction. The X direction coincides with a longitudinal direction of the fixing table 201. The Y direction is perpendicular to the X direction on a plane parallel to an upper surface 201*a* (placement surface) of the fixing table 201. Note that X, Y, and Z directions in FIGS. 4-6 are the same as those in FIG. 3.

The fixing table 201 corresponds to a fixing table for fixing a standard panel for testing in JIS K5600-5-5. The fixing table 201 has the upper surface 201*a*, one end 201*b*, and another end 201*c*. The one end 201*b* is opposite to the two shaft supports 205.

The fixing jig 202 is disposed on a side of the other end 201*c* of the upper surface 201*a* of the fixing table 201. The fixing jig 202 fixes a measurement target (photosensitive member 1) to the upper surface 201*a* of the fixing table 201. The upper surface 201*a* of the fixing table 201 is horizontal.

Figure 4:
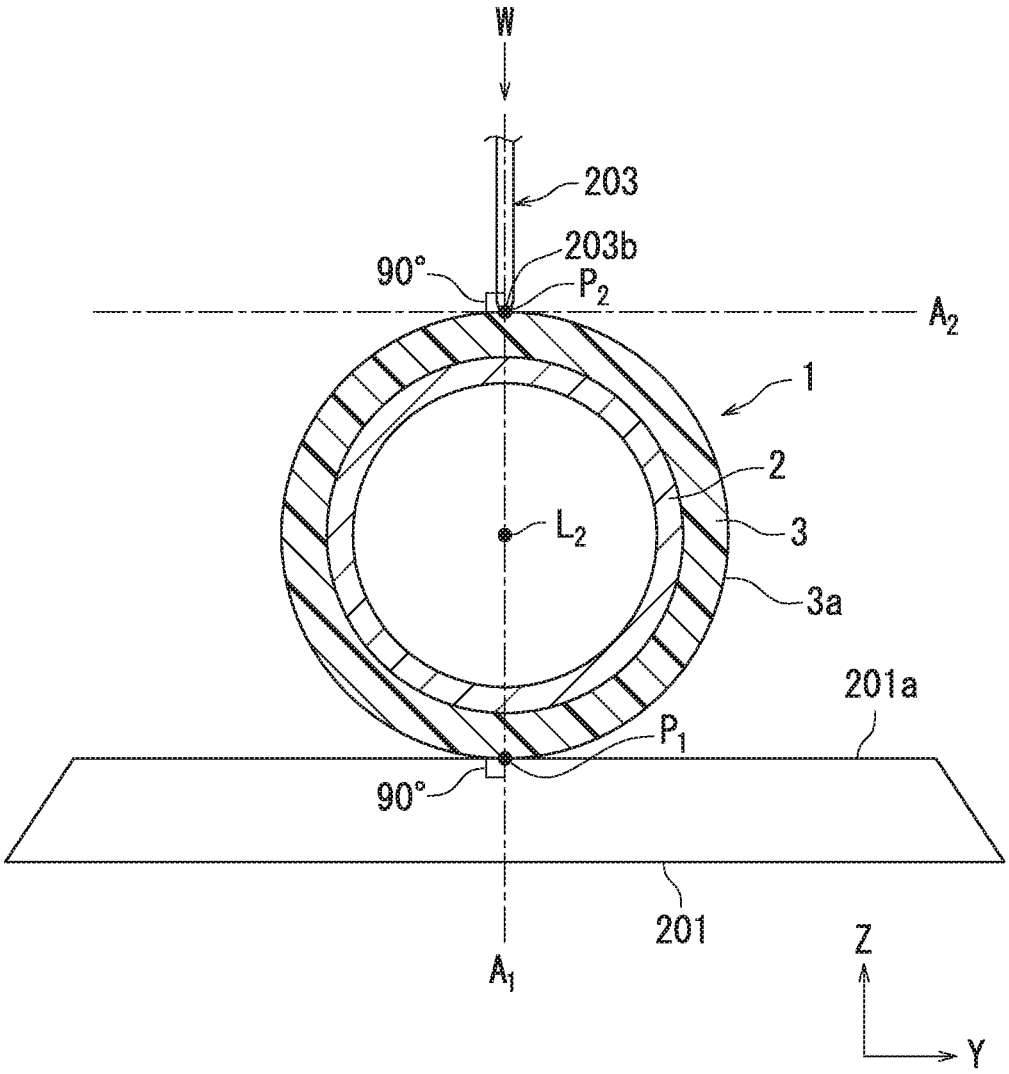
FIG. 4 is a cross-sectional view taken along the line IV-IV in FIG. 3.

The scratching stylus 203 has a hemispherical tip end 203*b* having a diameter of 1 mm (see FIG. 4). The tip end 203*b* of the scratching stylus 203 is made from sapphire.

The support arm 204 supports the scratching stylus 203. The support arm 204 pivots about the support shaft 204*a* as a pivot center in a direction in which the scratching stylus 203 moves to and away from the photosensitive member 1.

The two shaft supports 205 support the support arm 204 in a pivotal manner.

The base 206 has an upper surface 206*a* having one end located on a side where the two shaft supports 205 are disposed.

The two rails 207 are disposed on a side of the other end of the upper surface 206*a* of the base 206. The two rails 207 are disposed in parallel to each other. The two rails 207 are each disposed in parallel to the longitudinal direction (X direction) of the fixing table 201. The fixing table 201 is disposed between the two rails 207. The fixing table 201 is movable horizontally in the longitudinal direction (X direction) of the fixing table 201 along the rails 207.

The weight pan 208 is disposed on the scratching stylus 203 with the support arm 204 therebetween. A weight 209 is placed on the weight pan 208.

The constant speed motor moves the fixing table 201 in the longitudinal direction (X direction) of the fixing table 201 along the rails 207.

The scratch depth measuring method will be described below. The scratch depth measuring method includes a first step, a second step, a third step, and a fourth step. The scratching apparatus 200 defined in JIS K5600-5-5 was used for the scratch depth measurement. A surface roughness tester ("HEIDON TYPE14" manufactured by Shinto Scientific Co., Ltd.) was used as the scratching apparatus 200. The scratch depth measurement was performed in an environment at a temperature of 23° C. and a relative humidity of 50% RH. A drum-shaped (cylindrical) photosensitive member 1 was used as a measurement target.

(First Step)

In the first step, the photosensitive member 1 was fixed onto the upper surface 201*a* of the fixing table 201 such that a longitudinal direction of the photosensitive member 1 was parallel to the longitudinal direction of the fixing table 201. A direction of a central axis L2 (rotational axis) of the photosensitive member 1 coincided with the longitudinal direction of the photosensitive member 1. That is, the photosensitive member 1 was mounted such that the longitudinal direction of the photosensitive member 1 was parallel to the longitudinal direction of the fixing table 201. In a configuration in which the photosensitive member 1 is in a sheet-like shape, a direction of a long side of the photosensitive member 1 coincides with the longitudinal direction thereof.

(Second Step)

In the second step, the scratching stylus 203 was brought into perpendicular contact with a surface 3*a* of a photosensitive layer 3 of the photosensitive member 1. Description will be made below with reference to FIGS. 4 and 5 in addition to FIG. 3 about a process of bringing the scratching stylus 203 into perpendicular contact with the surface 3*a* of the photosensitive layer 3 of the drum-shaped photosensitive member 1.

FIG. 4 is a cross-sectional view taken the line IV-IV in FIG. 3 and illustrating the scratching stylus 203 in contact with the photosensitive member 1. FIG. 5 is a side view of the fixing table 201, the scratching stylus 203, and the photosensitive member 1 illustrated in FIG. 3. The scratching stylus 203 was moved toward the photosensitive member 1 such that an extension of a central axis $A_1$ of the scratching stylus 203 was perpendicular to the upper surface 201*a* of the fixing table 201. Specifically, the tip end 203*b* of the scratching stylus 203 was brought into contact with a point (contact point $P_2$) of the surface 3*a* of the photosensitive layer 3 of the photosensitive member 1 that was farthest from the upper surface 201*a* of the fixing table 201 in a vertical direction (Z direction). Through the above, the tip end 203*b* of the scratching stylus 203 was placed in contact with the surface 3*a* of the photosensitive layer 3 of the photosensitive member 1 at the contact point $P_2$. The tip end 203*b* of the scratching stylus 203 was in contact with the photosensitive member 1 such that the central axis $A_1$ of the scratching stylus 203 was perpendicular to a tangent $A_2$. The tangent $A_2$ is a tangent of the contact point $P_2$ to a circumscribed circle that a section of the photosensitive member 1 perpendicular to the central axis $L_2$ of the photosensitive member 1 forms. Through the above, the scratching stylus 203 was in perpendicular contact with the surface 3*a* of the photosensitive layer 3 of the photosensitive member 1. In a configuration in which the photosensitive member 1 is in a sheet-like shape, the scratching stylus 203 is placed in contact with the surface 3*a* of the photosensitive layer 3 such that the central axis $A_1$ of the scratching stylus 203 is perpendicular to a plane in contact with the surface 3*a* of the photosensitive layer 3 of the photosensitive member 1.

A positional relationship among the fixing table 201, the photosensitive member 1, and the scratching stylus 203 was as follows when the scratching stylus 203 was in perpendicular contact with the surface 3*a* of the photosensitive layer 3 through the above process. The extension of the central axis $A_1$ of the scratching stylus 203 perpendicularly intersected with the central axis $L_2$ of the photosensitive member 1 at an intersection point $P_3$. The intersection point $P_3$, a contact point $P_1$ between the photosensitive layer 3 and the upper surface 201*a* of the fixing table 201, and the contact point $P_2$ between the photosensitive layer 3 and the tip end 203*b* of the scratching stylus 203 were aligned on the extension of the central axis $A_1$ of the scratching stylus 203. The extension of the central axis $A_1$ was perpendicular to the tangent $A_2$ and the upper surface 201*a* of the fixing table 201.

(Third Step)

In the third step, 10 g of a load W was applied to the photosensitive layer 3 through the scratching stylus 203 in perpendicular contact with the surface 3*a* of the photosensitive layer 3. Specifically, the weight 209 having a weight of 10 g was placed on the weight pan 208. The fixing table 201 was moved in this state. Specifically, the constant speed motor was driven to horizontally move the fixing table 201 in the longitudinal direction thereof (X direction) along the rails 207. In other words, the one end 201*b* of the fixing table 201 was moved from a first point $N_1$ to a second point $N_2$. The second point $N_2$ was located downstream of the first point $N_1$ in a direction in which the fixing table 201 is away from the two shaft supports 205 in the longitudinal direction of the fixing table 201. The photosensitive member 1 was also moved horizontally in the longitudinal direction of the fixing table 201 along with the movement of the fixing table 201 in the longitudinal direction thereof. The travel speed of the fixing table 201 and the photosensitive member 1 was 30 mm/min. The travel distance of the fixing table 201 and the photosensitive member 1 was 30 mm. The travel distance of the fixing table 201 and the photosensitive member 1 corresponds to a distance $D_{1\text{-}2}$ between the first and second points $N_1$ and $N_2$. As a result of the movement of the fixing table 201 and the photosensitive member 1, a scratch S was formed on the surface 3*a* of the photosensitive layer 3 of the photosensitive member 1 by the scratching stylus 203. The scratch S will be described with reference to FIG. 6 in addition to FIGS. 3-5. FIG. 6 illustrates the scratch S formed on the surface 3*a* of the photosensitive layer 3. The formed scratch S was perpendicular relative to the tangent $A_2$ and the upper surface 201*a* of the fixing table 201. The formed scratch S was along a line $L_3$ in FIG. 5. The line $L_3$ is aggregation of a plurality of contact points $P_2$. The line $L_3$ is parallel to the upper surface 201*a* of the fixing table 201 and the central axis $L_2$ of the photosensitive member 1. The line $L_3$ is perpendicular (90 degrees) to the central axis $A_1$ of the scratching stylus 203.

(Fourth Step)

In the fourth step, a scratch depth that was a maximum depth $Ds_{max}$ of the scratch S was measured. Specifically, the photosensitive member 1 was taken out from the fixing table 201. The scratch S formed on the photosensitive layer 3 of the photosensitive member 1 was observed at a magnification of 5× using a three-dimensional interference microscope ("WYKO NT-1100" available at Bruker Corporation) to measure depths Ds of the scratch S. The depths Ds of the scratch S corresponded to distances from the tangent $A_2$ to respective parts of a bottom of the scratch S. A maximum depth $Ds_{max}$ among the depths Ds of the scratch S was determined to be a scratch depth.

[Performance Evaluation on Photosensitive Member]

(Anti-Fogging Property Evaluation)

Anti-fogging property evaluation was performed on images formed using the respective produced photosensitive members (A-1)-(A-25) and (B-1)-(B-8). An image forming apparatus modified version of a monochrome printer "FS-1300D" manufactured by KYOCERA Document Solutions Inc.) was used as an evaluation apparatus. The evaluation apparatus performed development by contact development and included no cleaner. The evaluation apparatus includes a charging roller as a charger. The evaluation apparatus included a developing device that removes toner remaining on a photosensitive member. Paper used for evaluation was Brand Paper of KYOCERA Document Solutions, VM-A4 (A4 size) available at KYOCERA Document Solutions Inc. The evaluation using the evaluation apparatus used a one-component developer (prototype).

An image I was successively printed on 12,000 pieces of the paper using the evaluation apparatus at a rotational speed of the photosensitive member of 168 mm/sec. The image I had a coverage rate of 1%. A white image was printed on a single piece of the paper then. The printing was performed in an environment at a temperature of 32.5° C. and a relative humidity of 80% RH. Respective image densities of three parts of the printed white image were measured using a reflectance densitometer ("RD914" manufactured by X-Rite Inc.). A sum of the image densities of the three parts of the white image was divided by the number of measured parts to calculate a number average value of the image densities of the white image. A value obtained by subtracting an image density of base paper from the number average value of the image densities of the white image was determined to be a fogging density. The following evaluation criteria were used for evaluation of calculated fogging densities. A photosensitive member evaluated as A or B was determined to be excellent in anti-fogging property. The fogging densities (FD values) and evaluation results are indicated in Tables 1 and 2.

Evaluation Criteria for Anti-Fogging Property

Evaluation A: Fogging density is no greater than 0.010.

Evaluation B: Fogging density is greater than 0.010 and no greater than 0.020.

Evaluation C: Fogging density is greater than 0.020.

Tables 1 and 2 indicate configurations and evaluation results of the respective photosensitive members (A-1)-(A-25). Table 2 indicates configurations and evaluation results of the respective photosensitive members (B-1)-(B-8). Molecular weights of respective binder resins in Tables 1 and 2 are indicated in terms of viscosity average molecular weight. R-1-R-6, R-11, and R12 in "Type" of "Binder resin" in Tables 1 and 2 represent the polyarylate resins (R-1)-(R-6), (R-11), and (R-12), respectively. R-7-R10 in a column "Type" of "Binder resin" in Table 2 represents the binder resins (R-7)-(R-10), respectively. HTM1-1-HTM8-1 in "Type" of "hole transport material" represent the hole transport materials (HTM1-1)-(HTM8-1), respectively.

TABLE 1

| | Photosensitive member | Binder resin Type | Binder resin Molecular weight | Hole transport material Type | Scratch depth [μm] | Vickers hardness [HV] | Anti-fogging property FD value | Anti-fogging property Evaluation |
|---|---|---|---|---|---|---|---|---|
| Example 1 | A-1 | R-1 | 35,300 | HTM1-1 | 0.46 | 20.6 | 0.008 | A |
| Example 2 | A-2 | R-2 | 36,600 | HTM1-1 | 0.14 | 22.4 | 0.003 | A |
| Example 3 | A-3 | R-3 | 34,400 | HTM1-1 | 0.43 | 18.8 | 0.008 | A |
| Example 4 | A-4 | R-4 | 35,600 | HTM1-1 | 0.32 | 22.0 | 0.004 | A |
| Example 5 | A-5 | R-5 | 34,600 | HTM1-1 | 0.30 | 21.1 | 0.003 | A |
| Example 6 | A-6 | R-6 | 35,800 | HTM1-1 | 0.45 | 19.3 | 0.009 | A |
| Example 7 | A-7 | R-1 | 35,300 | HTM2-1 | 0.44 | 22.2 | 0.007 | A |
| Example 8 | A-8 | R-2 | 36,600 | HTM2-1 | 0.13 | 24.0 | 0.003 | A |
| Example 9 | A-9 | R-3 | 34,400 | HTM2-1 | 0.40 | 20.3 | 0.007 | A |
| Example 10 | A-10 | R-4 | 35,600 | HTM2-1 | 0.30 | 23.5 | 0.004 | A |
| Example 11 | A-11 | R-5 | 34,600 | HTM2-1 | 0.29 | 22.5 | 0.003 | A |
| Example 12 | A-12 | R-6 | 35,800 | HTM2-1 | 0.43 | 21.0 | 0.007 | A |
| Example 13 | A-13 | R-1 | 35,300 | HTM6-1 | 0.45 | 20.2 | 0.009 | A |
| Example 14 | A-14 | R-2 | 36,600 | HTM6-1 | 0.42 | 22.6 | 0.004 | A |
| Example 15 | A-15 | R-3 | 34,400 | HTM6-1 | 0.15 | 18.9 | 0.008 | A |
| Example 16 | A-16 | R-4 | 35,600 | HTM6-1 | 0.39 | 21.5 | 0.003 | A |
| Example 17 | A-17 | R-5 | 34,600 | HTM6-1 | 0.30 | 20.6 | 0.003 | A |
| Example 18 | A-18 | R-6 | 35,800 | HTM6-1 | 0.42 | 19.2 | 0.008 | A |
| Example 19 | A-19 | R-4 | 35,600 | HTM3-1 | 0.35 | 20.8 | 0.005 | A |
| Example 20 | A-20 | R-4 | 35,600 | HTM4-1 | 0.34 | 21.1 | 0.006 | A |

TABLE 2

| | Photosensitive member | Binder resin Type | Binder resin Molecular weight | Hole transport material Type | Scratch depth [μm] | Vickers hardness [HV] | Anti-fogging property FD value | Anti-fogging property Evaluation |
|---|---|---|---|---|---|---|---|---|
| Example 21 | A-21 | R-4 | 35,600 | HTM5-1 | 0.36 | 20.9 | 0.005 | A |
| Example 22 | A-22 | R-11 | 33,300 | HTM2-1 | 0.31 | 22.2 | 0.003 | A |
| Example 23 | A-23 | R-12 | 35,600 | HTM2-1 | 0.32 | 23.4 | 0.004 | A |
| Example 24 | A-24 | R-4 | 35,600 | HTM7-1 | 0.36 | 18.5 | 0.004 | A |
| Example 25 | A-25 | R-4 | 35,600 | HTM7-2 | 0.35 | 18.2 | 0.005 | A |
| Comparative Example 1 | B-1 | R-7 | 31,000 | HTM1-1 | 0.88 | 12.2 | 0.032 | C |
| Comparative Example 2 | B-2 | R-8 | 32,500 | HTM1-1 | 0.91 | 13.5 | 0.035 | C |
| Comparative Example 3 | B-3 | R-9 | 33,000 | HTM1-1 | 0.70 | 18.1 | 0.029 | C |
| Comparative Example 4 | B-4 | R-10 | 34,500 | HTM1-1 | 0.89 | 17.9 | 0.044 | C |
| Comparative Example 5 | B-5 | R-9 | 33,000 | HTM7-1 | 1.22 | 14.4 | 0.090 | C |
| Comparative Example 6 | B-6 | R-9 | 33,000 | HTM8-1 | 1.36 | 14.3 | 0.100 | C |
| Comparative Example 7 | B-7 | R-3 | 34,400 | HTM7-1 | 0.49 | 14.2 | 0.029 | C |
| Comparative Example 8 | B-8 | R-3 | 34,400 | HTM8-1 | 0.48 | 14.4 | 0.031 | C |

As indicated in Tables 1 and 2, photosensitive layers of the respective photosensitive members (A-1)-(A-25) each were a single-layer photosensitive layer. The photosensitive layers each had a scratch depth of at least 0.13 μm and no greater than 0.46 μm. The photosensitive layers each had a Vickers hardness of at least 18.8 HV and no greater than 24.0 HV. The photosensitive layers each contained a hole transport material and the polyarylate resin (1) as a binder resin. Specifically, the photosensitive layers of the photosensitive members (A-1)-(A-25) each contained any one of the polyarylate resins (R-1)-(R-6), (R-11), and (R-12) and any one of the hole transport materials ((HTM1-1)-(HTM7-1). The polyarylate resins (R-1)-(R-6), (R-11), and (R-12) each were the polyarylate resin represented by general formula (1). The hole transport materials (HTM1-1)-(HTM7-2) were hole transport materials represented by general formulas (HTM1)-(HTM7), respectively. As indicated in Tables 1 and 2, the photosensitive members (A-1)-(A-25) were all evaluated as A in the anti-fogging property evaluation.

As indicated in Table 2, photosensitive layers of the respective photosensitive members (B-1)-(B-8) each were a single-layer photosensitive layer. The photosensitive layers each contained a hole transport material and a polyarylate resin as a binder resin. Specifically, the photosensitive layers of the respective photosensitive members (B-1)-(B-6) each contained any one of the binder resins (R-7)-(R-10). The binder resins (R-7)-(R-10) were not the polyarylate resin represented by general formula (1). The photosensitive layers of the respective photosensitive members (B-5)-(B-8) each contained the hole transport material (HTM7-1) or (HTM8-1). The hole transport materials (HTM7-1) and (HTM8-1) each were not a hole transport material represented by any of general formulas (HTM1)-(HTM6). The photosensitive layers of the respective photosensitive members (B-1), (B-2), and (B-5)-(B-8) each had a Vickers hardness of less than 17.0 HV. The photosensitive layers of the respective photosensitive members (B-1)-(B-6) each had a scratch depth greater than 0.50 μm. As indicated in Table 2, the photosensitive members (B-1)-(B-8) were all evaluated as C in the anti-fogging property evaluation.

As evident from Tables 1 and 2, the photosensitive member 1 according to the first embodiment (photosensitive members (A-1)-(A-25)) was excellent in result of the anti-fogging property evaluation when compared to the photosensitive members (B-1)-(B-8). Consequently, it is clear that the photosensitive member 1 according to the present disclosure is excellent in anti-fogging property.

As indicated in Table 1, the photosensitive layers of the respective photosensitive members (A-2), (A-4), (A-5), (A-8), (A-10), (A-11), (A-14), (A-16), and (A-17) contained any one of the polyarylate resins (R-2), (R-4), and (R-5) as a binder resin and any one of the hole transport materials (HTM1-1), (HTM2-1), and (HTM6-1). The photosensitive layers each had an FD value of at least 0.003 and no greater than 0.004, as indicated in Table 1.

As indicated in Table 1, the photosensitive layers of the respective photosensitive members (A-1), (A-3), (A-6), (A-7), (A-9), (A-12), (A-13), (A-15), and (A-18) contained any one of the polyarylate resins (R-1), (R-3), and (R-6) as a binder resin. The photosensitive layers of the respective photosensitive members (A-19)-(A-21) each contained any one of the hole transport materials (HTM-3), (HTM-4), and (HTM-5). As indicated in Table 1, the photosensitive members (A-1), (A-3), (A-6)-(A-13), (A-15), and (A-18)-(A-21) each had an FD value of at least 0.006 and no greater than 0.009.

As evident from Table 1, the photosensitive members (A-2), (A-4), (A-5), (A-8), (A-10), (A-11), (A-14), (A-16), and (A-17) each had a smaller FD value than the photosensitive members (A-1), (A-3), (A-6), (A-7), (A-9), (A-12), (A-13), (A-15), and (A-18). Consequently, it is clear that anti-fogging property of the photosensitive members (A-1), (A-3), (A-6)-(A-13), (A-15), and (A-18)-(A-21) was further improved.

What is claimed is:

1. An electrophotographic photosensitive member comprising a conductive substrate and a photosensitive layer, wherein the photosensitive layer is a single-layer photosensitive layer, the photosensitive layer contains a charge generating material, a hole transport material, an electron transport material, and a binder resin, the binder resin contains a polyarylate resin, a combination of the polyarylate resin and the hole transport material is either:

a combination of a polyarylate resin represented by a chemical formula (R-2) and a hole transport material represented by a chemical formula (HTM2-1); or a combination of a polyarylate resin represented by a chemical formula (R-3) and a hole transport material represented by a chemical formula (HTM6-1), the photosensitive layer has a scratch resistance depth of no greater than 0.50 μm, the photosensitive layer has a Vickers hardness of at least 17.0 HV, the scratch resistance depth of the photosensitive layer is measured by a measurement method using a scratching apparatus, the scratching apparatus includes a scratching stylus and a fixing table having an upper surface in a rectangular shape, the scratching stylus has a hemispherical sapphire tip end having a diameter of 1 mm, and the measurement method includes:

fixing the electrophotographic photosensitive member onto the upper surface of the fixing table such that a longitudinal direction of the electrophotographic photosensitive member is parallel to a longitudinal direction of the fixing table;

bringing the scratching stylus into perpendicular contact with a surface of the photosensitive layer;

forming a scratch on the surface of the photosensitive layer by the scratching stylus in a manner that the fixing table and the electrophotographic photosensitive member fixed on the upper surface of the fixing table are moved by 30 mm at a speed of 30 mm/minute while 10 g of a load is applied to the photosensitive layer through the scratching stylus in perpendicular contact with the surface of the photosensitive layer; and measuring the scratch resistance depth that is a maximum depth of the scratch, (HTM2-1)

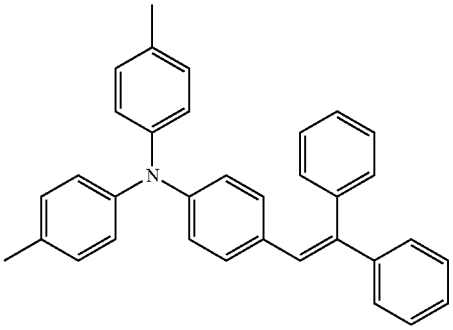

(HTM6-1)

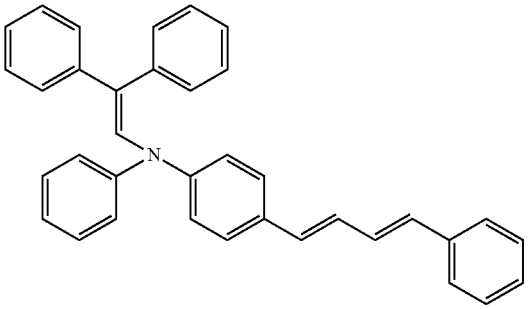

(R-2)

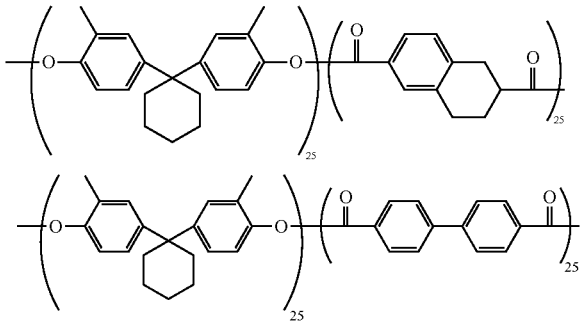

(R-3)

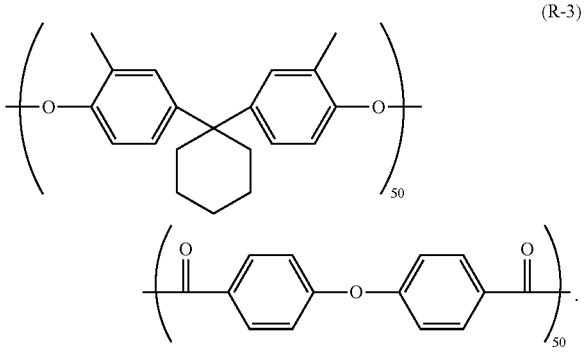

2. The electrophotographic photosensitive member according to claim 1, wherein the electron transport material is represented by general formula (ETM1), (ETM1)

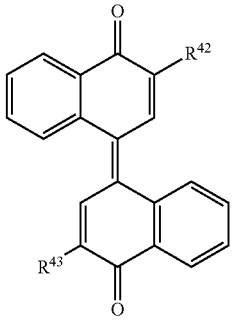

where, in the general formula (ETM1), $R^{42}$ and $R^{43}$ each represent, independently of one another, an alkyl group having 1 to 6 carbon atoms or an alkoxy group having 1 to 6 carbon atoms.

3. The electrophotographic photosensitive member according to claim 2, wherein in the general formula (ETM1), $R^{42}$ and $R^{43}$ each represent, independently of one another, an alkyl group having 1 to 5 carbon atoms.

4. The electrophotographic photosensitive member according to claim 1, wherein the charge generating material is X-form metal-free phthalocyanine.

5. A process cartridge comprising the electrophotographic photosensitive member according to claim 1.

6. An image forming apparatus comprising:

an image bearing member;

a charger configured to charge a surface of the image bearing member;

an exposure section configured to expose the charged surface of the image bearing member to form an electrostatic latent image on the surface of the image bearing member;

a developing device configured to develop the electrostatic latent image into a toner image; and a transfer section configured to transfer the toner image from the image bearing member to a recording medium, wherein the image bearing member is the electrophotographic photosensitive member according to claim 1, the charger has a positive charge polarity, and the transfer section transfers the toner image to the recording medium in a state in which the surface of the image bearing member is in contact with the recording medium.

7. The image forming apparatus according to claim 6, wherein the developing device develops the electrostatic latent image into the toner image while in contact with the surface of the image bearing member.

8. The image forming apparatus according to claim 6, wherein the developing device cleans the surface of the image bearing member.

9. The image forming apparatus according to claim 6, wherein the charger is a charging roller.

* * * * *